US005682436A

United States Patent [19]

Sakamoto et al.

[11] Patent Number: 5,682,436

[45] Date of Patent: Oct. 28, 1997

[54] MULTIPOINT DRIVING LOUDSPEAKER HAVING REPULSION MAGNETIC-TYPE DRIVING UNIT

[75] Inventors: Yoshio Sakamoto; Toshitaka Kawamidori, both of Hachiouji, Japan

[73] Assignee: Kabushiki Kaisha Kenwood, Tokyo, Japan

[21] Appl. No.: 451,497

[22] Filed: May 26, 1995

[30] Foreign Application Priority Data

Jun. 6, 1994 [JP] Japan ..... 6-147046

[51] Int. Cl.[6] ..... H04R 25/00

[52] U.S. Cl. ..... 381/196; 181/148; 381/194; 381/199

[58] Field of Search ..... 381/196, 182, 381/199, 194, 195, 205, 186, 192; 181/144

[56] References Cited

U.S. PATENT DOCUMENTS

| | | | |
|---|---|---|---|
| 4,783,824 | 11/1988 | Kobayashi | 381/195 |
| 4,868,882 | 9/1989 | Ziegenberg et al. | 381/200 |
| 5,214,710 | 5/1993 | Ziegenberg et al. | 381/194 |
| 5,371,806 | 12/1994 | Kohara et al. | 381/199 |
| 5,511,131 | 4/1996 | Kohara et al. | 381/194 |
| 5,550,332 | 8/1996 | Sakamoto | 181/148 |
| 5,590,210 | 12/1996 | Matsuo et al. | 381/199 |
| 5,594,805 | 1/1997 | Sakamoto et al. | 381/199 |

FOREIGN PATENT DOCUMENTS

| | | | |
|---|---|---|---|
| 0268399 | 10/1989 | Japan | 381/199 |
| 40602239 | 1/1994 | Japan | 381/199 |
| 406086385 | 3/1994 | Japan | 381/199 |

*Primary Examiner*—Curtis Kuntz
*Assistant Examiner*—Rexford Barnie
*Attorney, Agent, or Firm*—Sixbey, Friedman, Leedom & Ferguson, P.C.; Gerald J. Ferguson, Jr.; Karlton C. Butts

[57] ABSTRACT

It is an object of the present invention to provide a loudspeaker structure suitable for use in almost full range in relation to a reproduction frequency band of a conventional ultrathin-type loudspeaker by resolving the defects of the loudspeaker and expanding the frequency band. A multipoint driving loudspeaker in which a single diaphragm is driven by a plurality of voice coils, having a plurality of holes 11*a* for connection with voice coils 12 at arbitrary positions on the diaphragm 11, an outer periphery of each voice coil or each voice coil bobbin 12*a* constituting the voice coil being joined to an inner periphery of each hole, each magnetic circuit for driving the voice coil being placed at an inner periphery of the voice coil or of the voice coil bobbin correspondingly to each voice coil, and the magnetic circuit including two magnets 82 with the same poles positioned at opposite side each other and being used as a repulsion magnetic circuit with a center plate 81 grasped between the magnets.

15 Claims, 19 Drawing Sheets

MULTIPOINT DRIVING LOUDSPEAKER HAVING REPULSION MAGNETIC-TYPE DRIVING UNIT

FIELD OF THE INVENTION

This invention relates to a structure of a multipoint driving loudspeaker having a wide reproduction frequency band as well as thin.

DESCRIPTION OF PRIOR ART

We have already proposed a thin-type loudspeaker as shown in FIG. 17 as a loudspeaker in which a mounting depth can be significantly decreased compared with a loudspeaker having a generally used conventional magnetic circuit, and in fact it has been actualized.

The loudspeaker in FIG. 17 includes magnets 82*a* and 82*b* placed in a thickness direction with the same poles placed at opposite side each other, a magnetic circuit called "repulsion magnetic circuit" with a center plate 81 made of magnetic materials being grasped between the two magnets, a voice coil 12 being placed within a repulsion magnetic field which occurs around the periphery of the center plate 81, and a neck portion of a cone diaphragm 11 being joined to an outer periphery of the voice coil 12 or of a voice coil bobbin 12*a*.

As a loudspeaker further thinner than this type of a loudspeaker, as shown in FIGS. 18(A) and 18(B), we have proposed a theoretically-thinnest loudspeaker (hereinafter totally referred to as "ultrathin loudspeaker") by setting a dimension of each section of the diaphragm 11 and an edge 15 to within a width of a reel of the voice coil 12, and in fact have materialized it.

Referring to the details of this ultrathin loudspeaker, it uses two ring-shaped neodymium magnets as magnets 82 having an outside diameter of 29 mm, an inside diameter of 12 mm, and a thickness of 7 mm, placed in a thickness direction. In this assembly, N poles of said magnets 82 are placed at opposite side each other between which a ring-shaped iron center plate 81, having an outside diameter of 29.95, an inside diameter of 11.9 mm, and a thickness of 4 mm, is grasped with an inside diameter portion and its ridge portion chamfered by CO.4.

This magnetic circuit is bonded to an aluminum frame 62 having a sectional configuration as shown in FIG. 18(A) (approx. 1.5 mm thick). A diaphragm system is arranged around this magnetic circuit. A diaphragm 11 of this system, having an extremely thin cone shape of 112-mm outside diameter, 33.1-mm inside diameter (a diameter of the neck portion), and 2.5-mm height, is formed by two pieces of diaphragm material of pulp including a rising portion of approximately 2 mm in the side of the neck portion with being laminated oppositely each other. Accordingly, its section is wedge-shaped as shown in FIG. 19(A) with a thickness gradually decreased from approximately 5 mm of a thickness of the neck portion to approximately 0.6 mm of the outermost periphery. An inside gap portion caused by the lamination is filled with another piece of pulp material, and the diaphragm 11 has approximately 4 g of weight.

An edge 15 is laminated as a suspension at the outer periphery of the diaphragm 11. Said edge 15 is made of sealed web having a configuration generally called "gathered edge," having the total width of the gather portion (corrugation) of approximately 17.5 mm, three corrugations, and the height of approximately 2.6 mmn. In addition, there are margins to paste each having a 6 mm width at the inside of said edge 15 (the side of the diaphragm 11) and an approximately 8 mm width at its outside (the side of ring 3), and to the outside margin of said edge 15, is bonded the ring 3 made of phenol resin having a 132-mm inside diameter, a 150-mm outside diameter, and a 2-mm thickness by means of rubber bond.

Although said edge 15 is formed by means of a general technique, thermoforming, prior to the forming process, is stitched the surface of the edge material coated with a resin of web mixed with rubber and phenol or the like by using a piece of flat meshed gilt yarn 15*a*, and after the forming, it is formed so as to be placed at the center line on the plane of said edge 15, said gilt yarn 15*a* is trimmed with a necessary length secured so that it reaches the neck portion, in other words, a hole 11*b* for joining with the voice coil 12, and then said margin to paste and an extension part of said flat meshed gilt yarn 15*a* are laminated on the surface of the diaphragm 11.

Therefore, as shown in FIG. 19, the gilt yarn 15*a* is put at an about center line of the diaphragm 11 and also at the outermost periphery of the edge 15, in other words, from the ring 3 to the hole 11*b* for joining with the voice coil symmetrically each side. Said gilt yarn 15*a* is mainly made of 200-denier para-aramid fiber by using flat meshed gilt yarn made of 13 pieces of gilt yarn flatly meshed with an approximately 27.45 mm/turn mesh pitch, each around which tin alloy copper foil of 0.32-mm width and 0.27-mm thickness is wound by 22 times/cm with a single layer.

The voice coil 12 is formed with a 30.5 mm inside diameter and the bobbin material made of a PPTA (polypara phenylene terephthalic amido) film which is 5.5 mm wide and 12 μ thick, said bobbin material around which a flat rectangular yarn made of copper clad aluminum is wound in approximately 5-mm winding width by a predetermined number of turns, the coil outer periphery around which is would a PPTA film of 5-mm width and 12-μ thickness by three or four layers, an external layer of said film on which a copper foil 12*b* of 3.0-mm width, 8-mm length, and 10-μ thickness is laminated at two places with a 180-degree angle, said copper foil 12*b* to which a coil terminal wire of the voice coil 12 is soldered, and further a tip of the flat meshed gilt yarn 15*a* reaching the neck portion of the diaphragm 11 to which the copper foil 12*b* is soldered after their position alignment, prior to bonding the diaphragm 11 to said voice coil 12 with bond coating.

The ring 3 put on the outer periphery of said edge 15 has holes at predetermined places, in other words, positions where are arranged the tip portions of the flat meshed gilt yarn 15*a* reaching the outer periphery of the edge 15, with the holes through which input terminal lugs 9 are fitted with caulking. Accordingly, a part of the terminal lugs 9 and the tip portions of the flat meshed gilt yarn 15*a* are pressure welded to complete the connection between said terminal lugs 9 and the flat meshed gilt yarn 15*a*. If this diaphragm system is bonded to a frame 61 at installation, a center line of the section of the diaphragm system is positioned at a center line of the magnetic circuit as shown in FIG. 18(B). In addition, if aluminum grill 62 having the same sectional configuration is installed, the diaphragm 11 is placed at a position where it is vertically symmetrical about said center line in a sectional view, so that the loudspeaker becomes totally approximately 23 mm thick with frequency characteristics as shown in FIG. 20.

While this ultrathin loudspeaker has a great deal of advantages for making thinner vehicle-mounted loudspeakers, it also has disadvantages. For example, since the diaphragm 11 has a schematically plane form, this type of loudspeaker is advantageous for lower frequency reproduction, but it is difficult to obtain sound pressure in a middle or higher frequency band. We have used the system as a sub-woofer loudspeaker unit whose frequency band to be used is restricted by utilizing the advantage on the lower frequency reproduction, and have already proposed a thin type screen loudspeaker in which this sub-woofer loudspeaker unit is used independently of this invention and have already materialized it.

As apparent from the frequency characteristics in FIG. 20, however, because of its lower sound pressure in reproduction of 200 Hz or more frequency band and occurrence of a peak or a dip, it is inappropriate as a loudspeaker for reproducing a middle or higher frequency band, and naturally, its range of use is limited to a certain range.

On the other hand, improvement of a space factor is extremely required for vehicle-mounted loudspeakers or visual loudspeakers in recent years, and therefore, there is a serious need for thinner loudspeakers. As described in the above, however, the conventional ultrathin loudspeaker has a structure which is suitable for use in an almost full range, that is, in a wide reproduction frequency band which is required for vehicle-mounted loudspeakers. Accordingly, there is a need for countermeasures to expand the reproduction frequency band of the ultrathin loudspeakers.

SUMMARY OF THE INVENTION

It is therefore a general object of this invention to provide a loudspeaker structure suitable for a use in an almost full range, by resolving the problems of the above conventional ultrathin loudspeakers to expand the reproduction frequency band of the loudspeakers.

To solve the above object, there is provided a multipoint driving loudspeaker having a plurality of holes for connection with a voice coil at arbitrary positions on a diaphragm, an outer periphery of each voice coil or each voice coil bobbin constituting said voice coil being joined to an inner periphery of the respective holes, and at an inner periphery of the voice coil or of the voice coil bobbin, two magnets being arranged with the same poles placed at opposite side each other to drive said voice coil correspondingly to each voice coil and a magnetic circuit being placed including the two magnets between which a center plate is grasped, According to the invention, the loudspeaker has a multipoint driving structure, therefore, it is possible to expand a reproduction frequency band significantly still further in comparison with that of the conventional ultrathin loudspeakers, so that the structure is suitable for use in an almost full range.

DETAILED DESCRIPTION OF THE EMBODIMENTS OF THE INVENTION

Figure 16A:
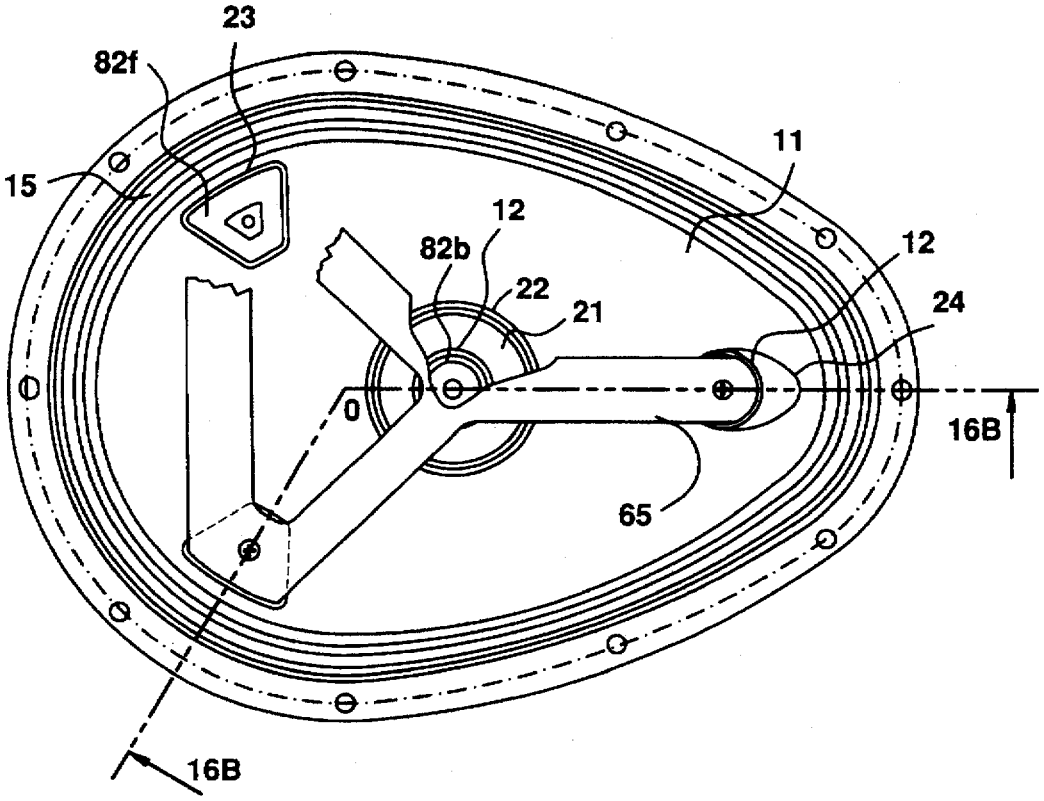
FIG. 16 is a from view (A) and a section (B) taken on line A-O-B in (A) illustrating another configuration in which the second diaphragm is placed in the diaphragm.
Figure 16B:
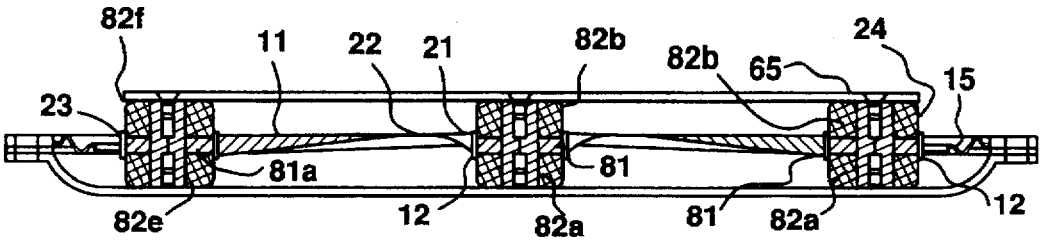
Figure 17:
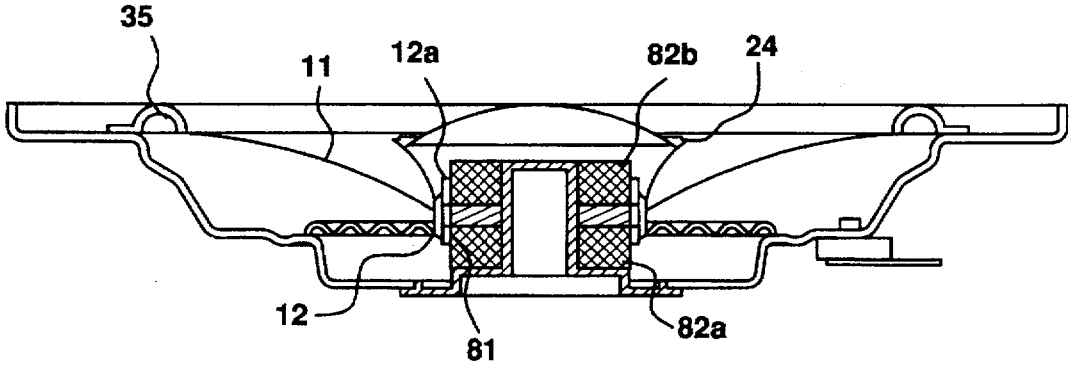
FIG. 17 is a section view of a thin-type loudspeaker we have already proposed.
Figure 18B:
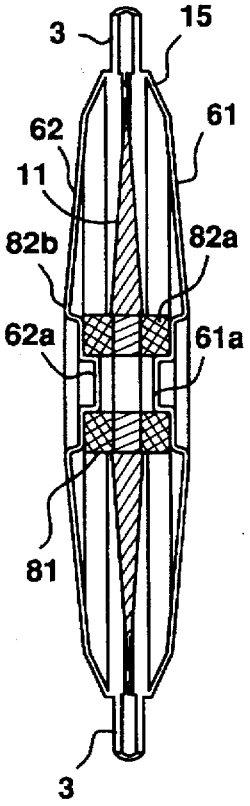
FIG. 18 is a front view (A) and a section view (B) of the ultrathin-type loudspeaker we have already proposed.
Figure 18A:
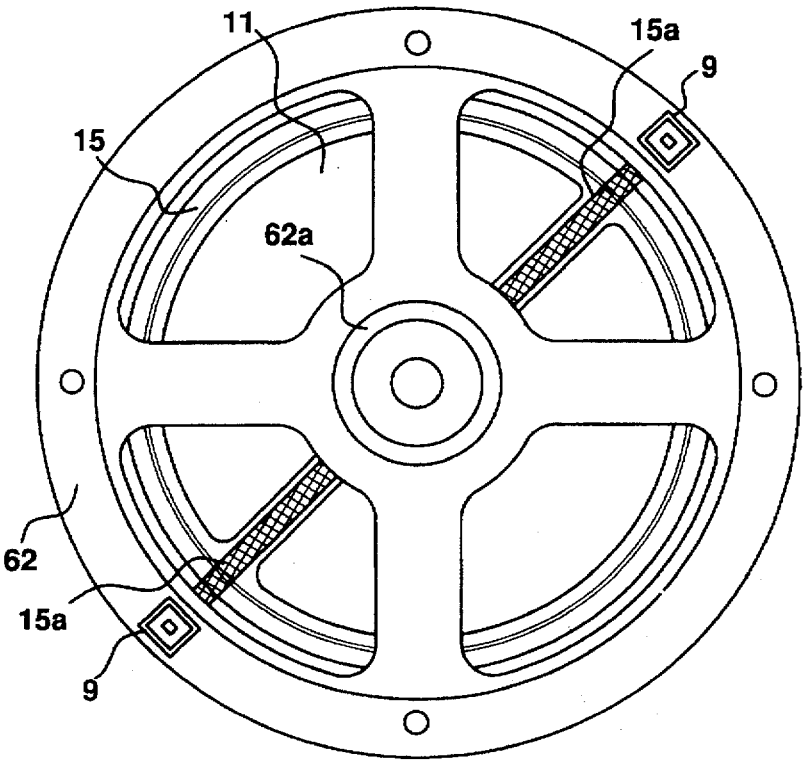
Figure 19A:
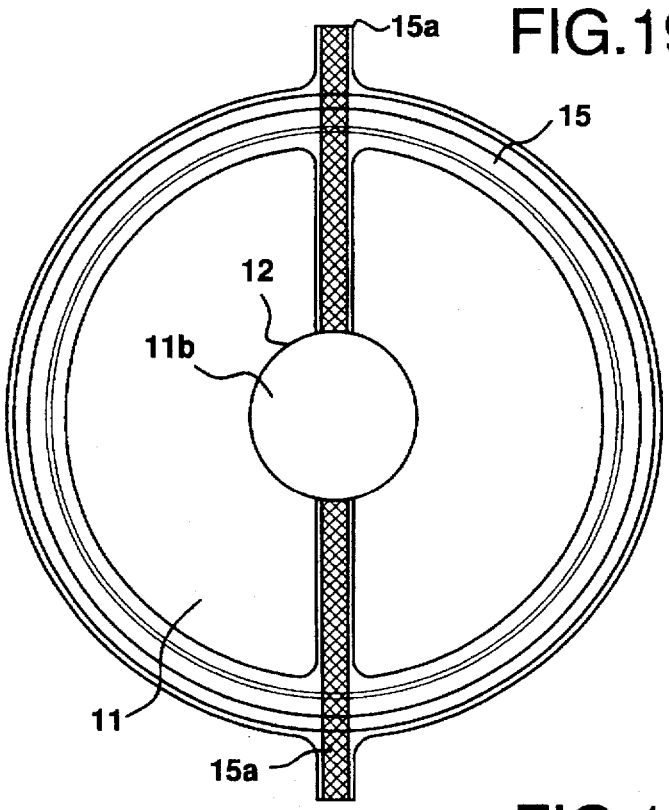
FIG. 19 is a front view (A) and an exploded view illustrating a diaphragm system of the ultrathin-type loudspeaker.
Figure 19B:
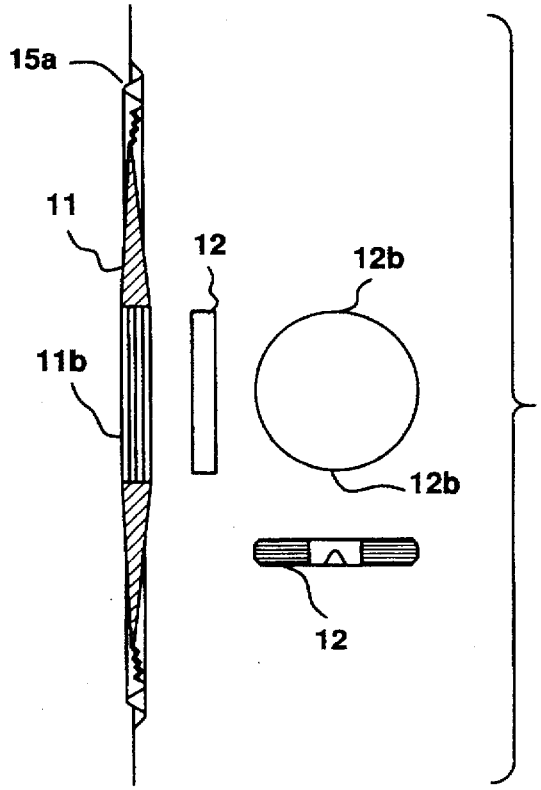
Figure 20:
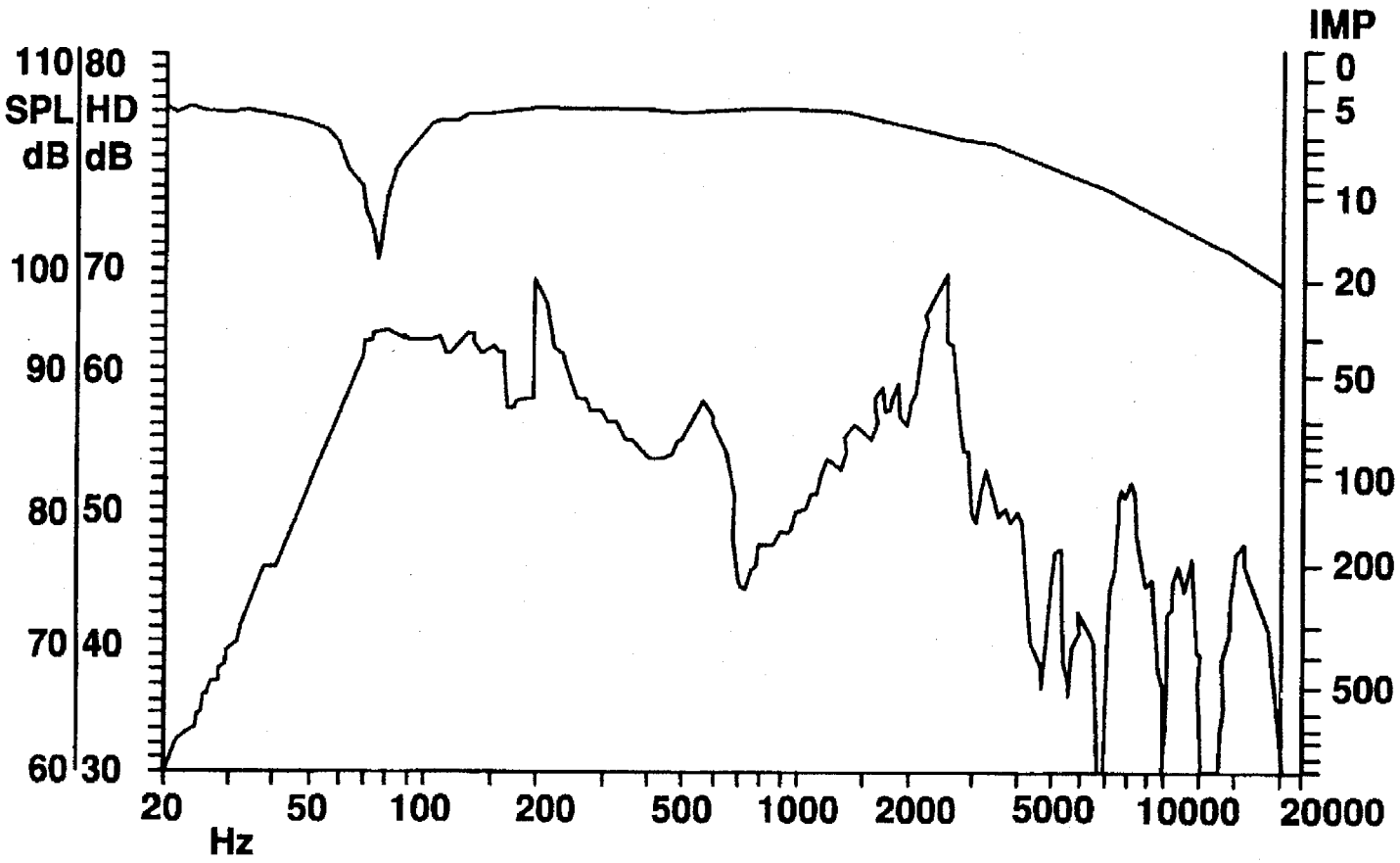
FIG. 20 is a frequency characteristic chart of the ultrathin-type loudspeaker we have already proposed.

Referring to FIGS. 1 to 16, a loudspeaker structure according to embodiments of the invention will be described, with the same reference characters designating the same parts as for the conventional loudspeakers described with reference to FIGS. 17 to 19, whose detailed description is omitted.

Figure 2A:
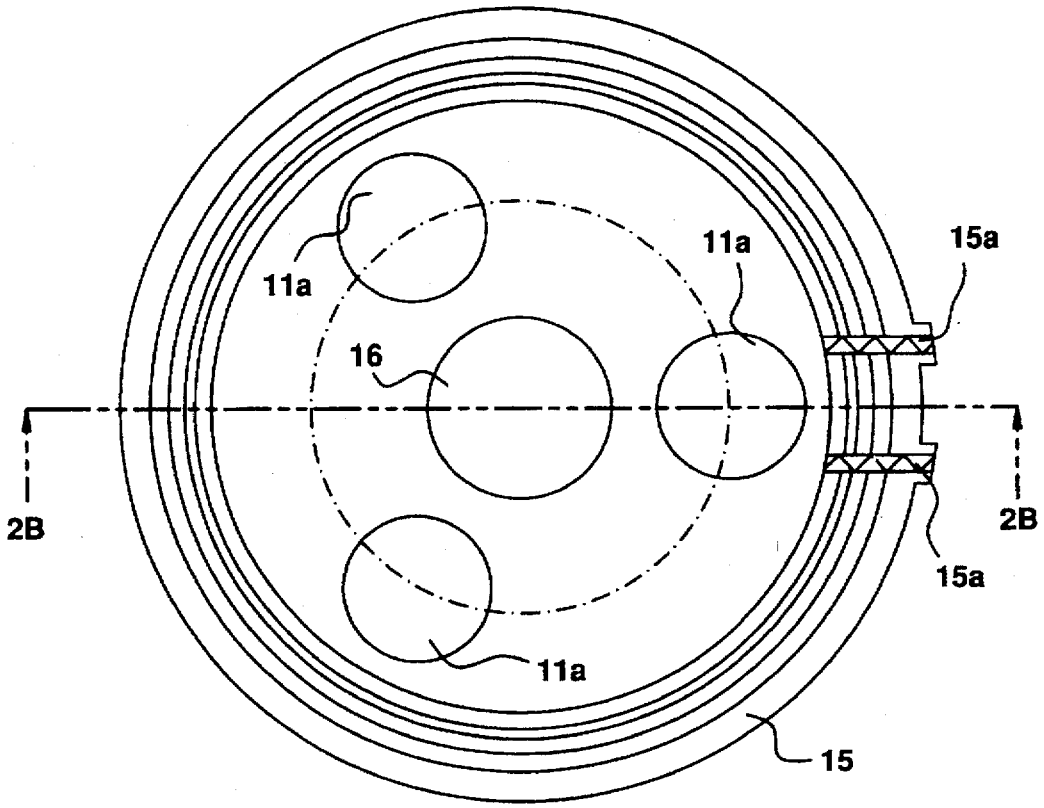
FIG. 2 is a front view (A) and a section (B) taken on line A-B in (A) illustrating a diaphragm of the loudspeaker.
Figure 2B:
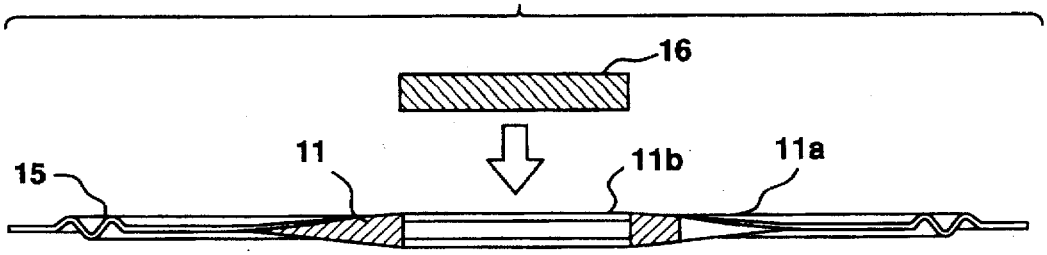

As for a diaphragm 11, is used the same diaphragm 11 as for the conventional one, conventionally with a hole **11*b* which is a neck portion at the center of the diaphragm 11 for joining with a voice coil 12, but with the hole 11*b* being filled up with balsa material 16 as shown in FIG. 2. In addition, as shown in a front view, there are three holes 11*a* (diameter: approximately 27.5 mm) for joining with the voice coil 12 at the positions away from the center of the diaphragm 11 by a 36-mm radius and at a 120-deg angle around the center. In this embodiment, the hole 11*b* is filled up with the balsa material 16 since the conventional diaphragm is used, but is obvious that an integrally molded diaphragm without the hole 11*b*** can be used at bulk production.

Figure 3A:
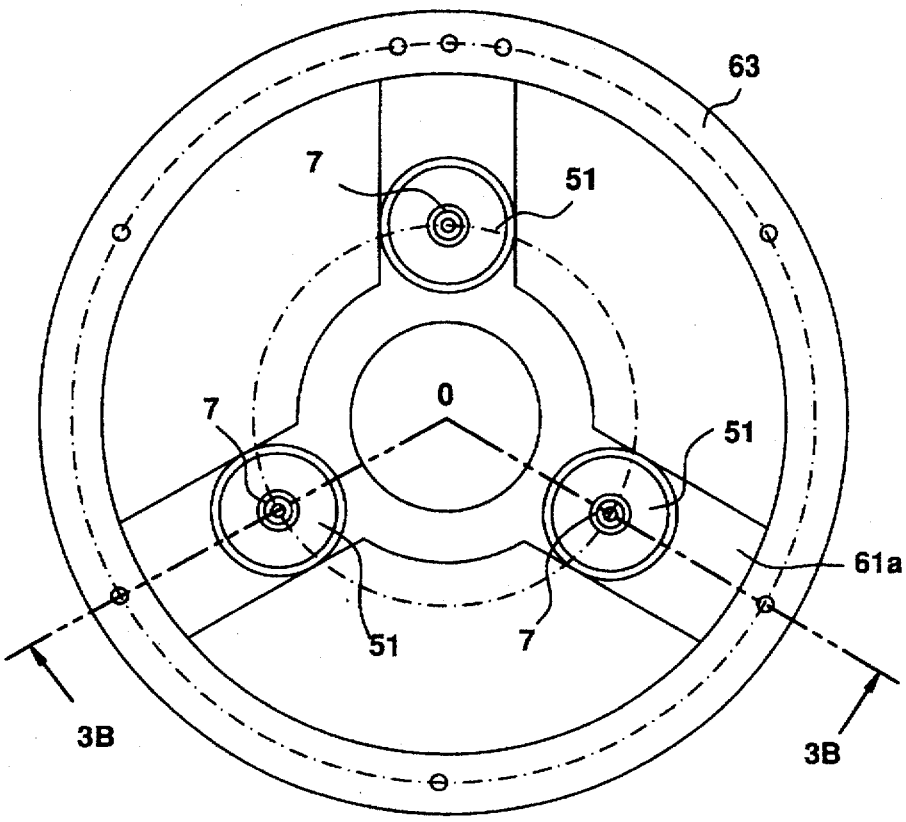
FIG. 3 is a front view (A) and a section (B) taken on line A-O-B in (A) illustrating an assembly process of the loudspeaker.
Figure 3B:
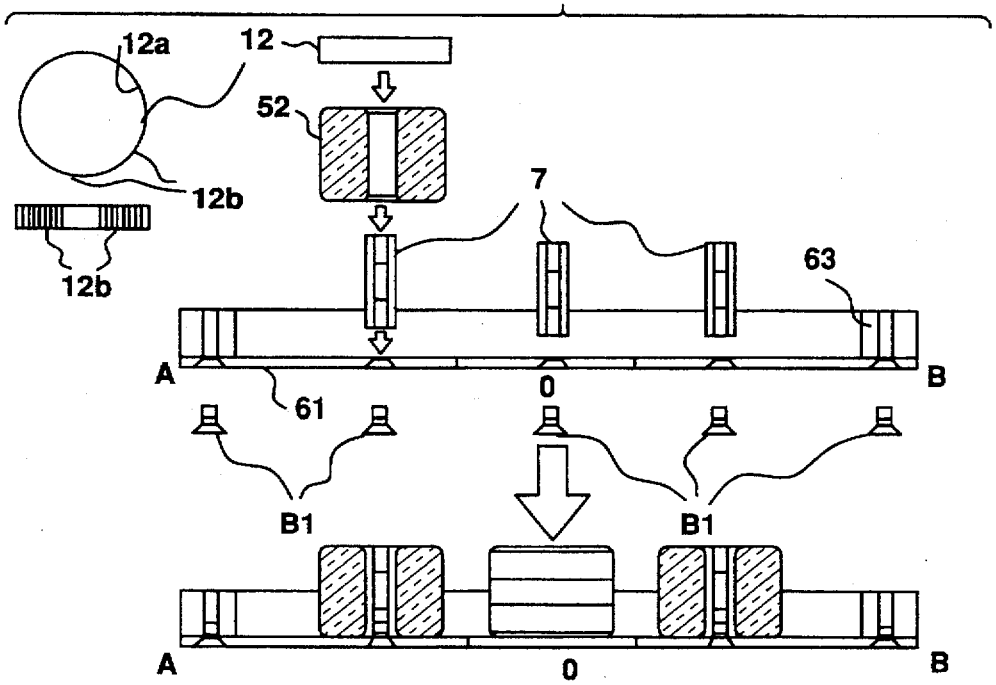

The voice coil 12 has an inside diameter of 25.9 mm, including a bobbin **12*a* comprising bobbin material made of a 6-mm-wide and 12-μ-thick PPTA film around which a copper clad aluminum wire having a predetermined thickness is wound in approximately 5.0-mm winding width by a predetermined number of turns so as to obtain an approximately 10.4-Ω dc resistance, an outer periphery of the coil around which a 5-mm-wide and 12-μ-thick PPTA film is wound by three or four layers, further, an external layer of said film on which a 5-mm-wide, 8-mm-long, and 10-μ-thick copper foil 12b is laminated at two places symmetrically away from the center line each by 55 mm in a coil side view shown in FIG. 3(B), in other words, at intervals of 10 mm, and said copper foil 12b to which a terminal wire of the voice coil 12** is soldered.

For an edge 15, is used the same edge as for the conventional one except changed the positions of the flat meshed gilt yarn 15a. In other words, two pieces of flat meshed gilt yarn 15a are stitched on a surface of the edge material at intervals of 21.2 mm in parallel prior to molding process, further after the molding process, molding is made so that they are arranged symmetrically about the center line of the plane of the edge 15 and it is trimmed into a ring form of an approximately 106-mm inside diameter and an approximately 140-mm outside diameter, and then it is bonded to a margin to paste in an inner periphery of the edge 15 and a margin to paste in an outer periphery of the diaphragm 11 with relative to the positions of the holes 11a for said voice coil.

In this embodiment, a frame for supporting the diaphragm system and the magnetic circuit is formed by working an aluminum plate and a resin plate into predetermined forms to make two sets each and assembling these parts 61, 62, 63, and 64. More specifically, the aluminum plate, which is 2 mm thick, is worked to a circular form of a 154-mm diameter, further are placed circles each having a 132-mm diameter and a 56-mm diameter inside the circular plate and also concentric with it, with connecting said circles by means of 12-mm wide straight lines at an angle of 120 degrees around the center of said frame and clipping shapes made by crossing of the lines also with the inside of the clipped portions clipped by a 36-mm diameter.

Figure 1A:
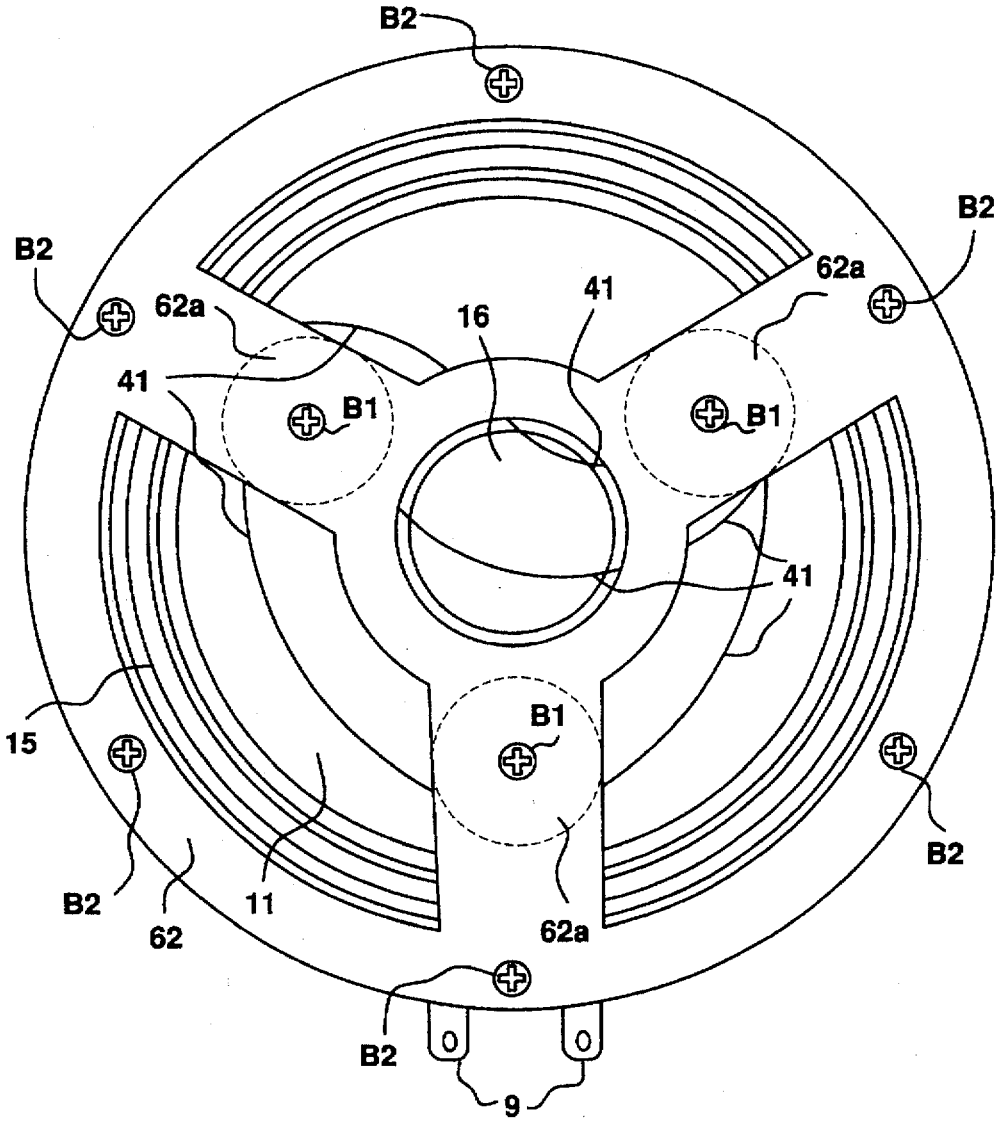
FIG. 1 is front view (A) and a side view (B) illustrating an embodiment of a loudspeaker structure according to the invention.
Figure 1B:
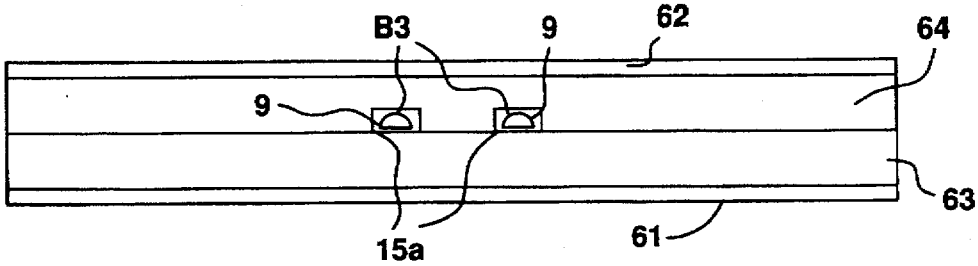

Accordingly, as shown in FIG. 1, an aperture of a 36-mm diameter is arranged at the center of the circular disc of a 154-mm diameter, and a fan-shaped aperture is arranged at three places each with an angle of 120 degrees enclosed by supports 61a and 62a each having a 12-mm width outside the aperture. In addition, countersinks for 3-mm screws are provided at positions on the center line of said supports 61a and 62a and away from the center of said frames 61 and 62 by a 36-m radius, and as shown in FIG. 1, an aluminum plate is used as the frames 61 and 62 each having countersinks for 3-mm screws at six places each with an angle of 60 degrees at positions away from the center of said frames 61 and 62 by a 72-mm radius.

The resin plate, which is acrylic, is worked into a ring form with a 9.9-mm thickness, a 154-mm outside diameter, and a 132-mm inside diameter; one ring 63 has 3-mm tapped holes at six places each with an angle of 60 degrees at positions away from the center of the ring 63 by a 71-mm radius and 3-mm tapped holes for installing an input terminal lug 9 at two places as shown in FIG. 3 with the same pitch, 21.2 mm as for the installation of the flat meshed gilt yarn 15a on said edge 15, with every eight tapped holes penetrating from the surface of said resin plate to its reverse side, and the other ring 64 has the same size of the thickness, outside diameter, and the inside diameter as for the ring 63, with 3.2-mm penetrating holes corresponding to the above-described six tapped positions with an angle of 60 degrees of the ring 63, but not having any tapped holes corresponding to said tapped positions for installing the input terminal lug 9, instead with 3-mm-wide and 3-mm-deep notches at two places as shown in FIG. 1.

The ring 63 is fixed to said frame 61 by means of countersunk screws B1 of a 3-mm diameter and a 5-mm length as shown in FIG. 3 since the countersinks on the outer periphery of the frame 61 correspond with the tapped positions as the ring 63. In addition, struts 7 for supporting the magnetic circuit are installed in the positions of the countersinks on said supports. Said struts 7, which are made of brass each having a 5.88-mm diameter and a 20-mm length, are fixed by countersunk screws B1 with a 3-mm diameter and a 5-mm length in the same manner as for the above since they have 3-mm tapped holes at the center of their both ends as shown in FIG. 3. Accordingly, three struts 7 stand on the supports 61a of the frame as shown in FIG. 3.

Figure 4A:
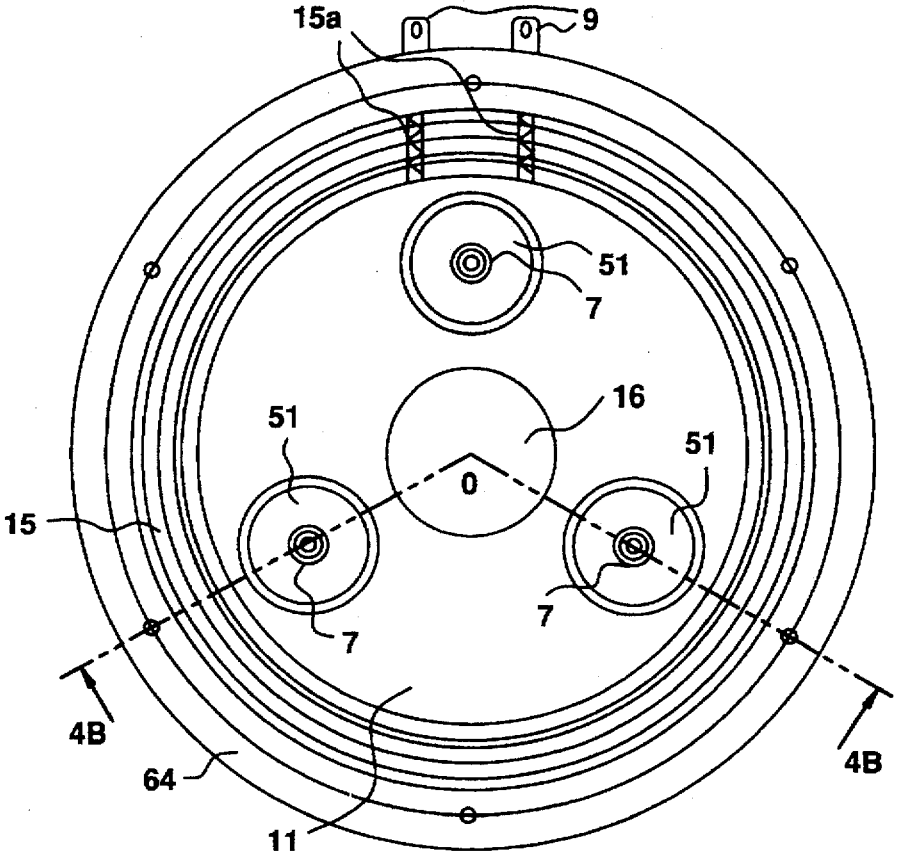
FIG. 4 is a front view (A) and a section (B) taken on line A-O-B in (A) illustrating an assembly process following the process in FIG. 3.
Figure 4B:
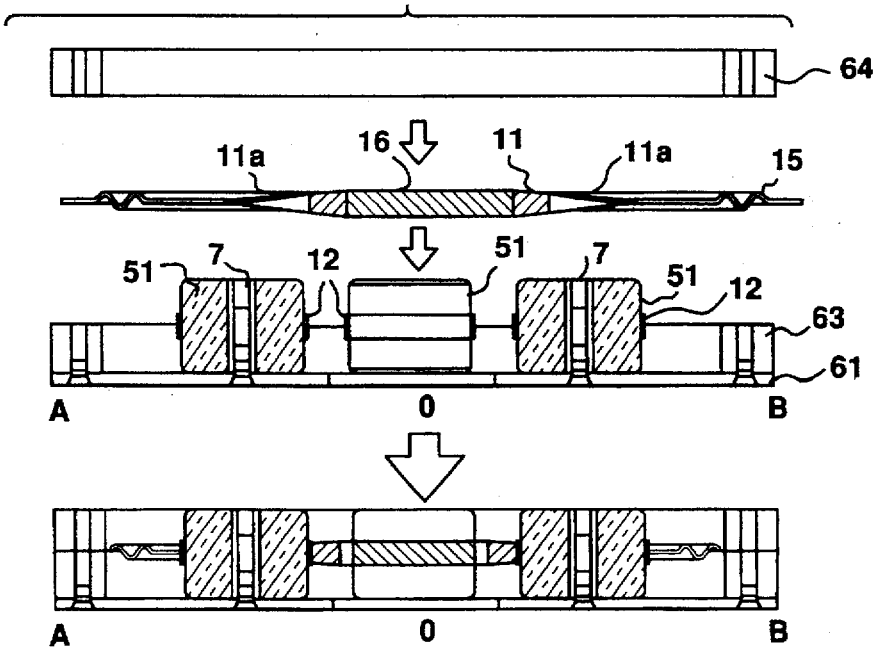

As shown in FIG. 4, the edge 15 is bonded to the ring 63 at the margin to paste on the outer periphery of the edge 15 of the diaphragm 11 after coating on the inner periphery at the upper edge face of the ring 63 with adhesive material. Prior to the bonding, the voice coil 12 is placed on the jig 51 so as to fit to the center of the jig in the lengthwise direction with adjustment of the coil width as shown in FIG. 3 by using voice coil positioning jigs 51 made of brass each having a 20-mm length and a 25.89-mm diameter with a hole of a 5.9-mm inside diameter around the same center position, and said struts 7 are inserted to the 5.9-mm holes at the center of the jigs. Therefore, when said jigs 51 into which the struts 7 are inserted into the holes 11a on said diaphragm 11, three holes 11a on the diaphragm 11 are placed at the predetermined positions around each strut 7 at three places on the frame 61 in the outer periphery of the three voice coils 12 set on the jigs 51. It should be noted, however, that said diaphragm 11 is bonded in a direction that the right side of the flat meshed gilt yarn 15a appears as shown in FIG. 4, in other words, that it faces the reverse side to the bonded surface.

Figure 5:
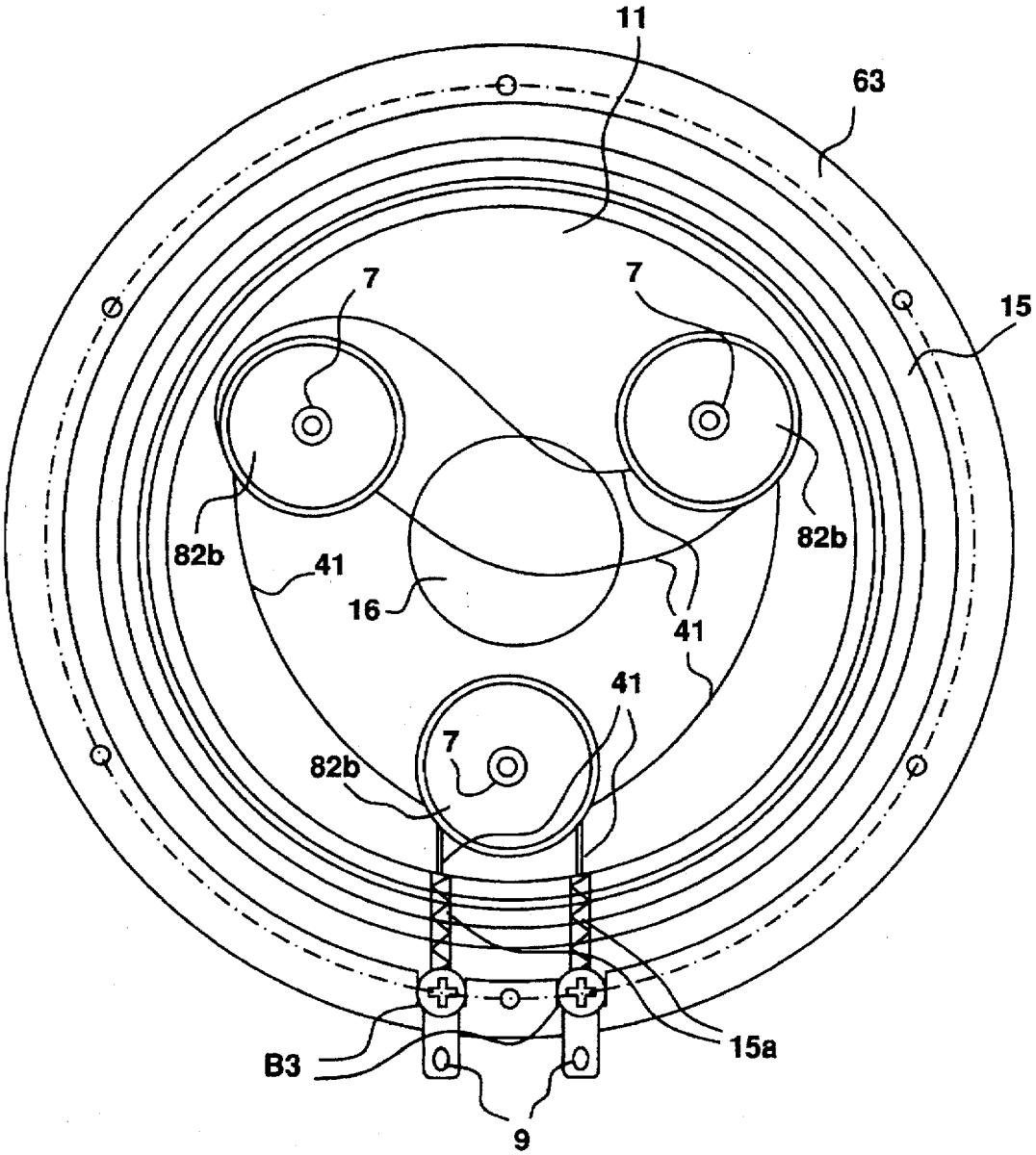
FIG. 5 is a wiring diagram of the loudspeaker.

In this condition, wiring is made between the voice coils 12 or between each coil and the input terminal lugs 9. In this embodiment, wiring leads 41, each made of 12 pieces of gilt yarns meshed in a form of a string, are trained over the diaphragm 11 as shown in FIG. 5, and the ends of the leads 41 are soldered to a copper foil 12b on the outer periphery of the voice coils 12 and also to input flat meshed gilt yarn 15a which reaches the voice coils 12a and the inner periphery of the edge 15. Since the copper foil 12b on the outer periphery of the voice coils 12 peeps out from the surface of the diaphragm 11, it is easy to solder the copper foil 12b to the ends of said leads 41. Since each terminal lead for each voice coil 12 has been already wired to the copper foil 12b of each voice coil 12 as described above, the coils are connected in parallel each other.

Further, the ends of the input flat meshed gilt yarn reaching the outer periphery of the edge 15 is connected to the input terminal lugs 9, with said ends arranged correspondingly to the positions of the 3-mm tapped holes for installing said terminal lugs. Accordingly, when each terminal lug 9 is fixed with a pan-head screw B3 of 3 mm×6 mm in a direction that the positive is in the right hand and the negative is in the left hand as shown in FIG. 5, a part of the terminal lug 9 is pressure welded to the end of the flat meshed gilt yarn 15a, which completes the connection. Although the installation is performed by the above means in this embodiment, it is natural that generally-used conventional caulking or the like is also effective for this installation.

In this condition, the voice coils 12 are bonded in said holes 11a on the diaphragm 11 by applying acrylic adhesive to the outer periphery of the voice coils 12. In this adhesive application process, rubber adhesive is applied so as to cover the soldered portions between said leads and copper foils 12*b*, and as for the leads over the surface of the diaphragm 11, to cover contact portions between the leads and the diaphragm 11 and the leads themselves to bond them to the surface of said diaphragm 11. Furthermore, damping material is applied to the entire range of the inner periphery of the corrugation and the outer periphery of the diaphragm by a predetermined width and amount. After the adhesive or damping material reaches a predetermined strength, said voice coil positioning jig 51 is pulled out of the struts 7, and instead, said struts 7 are inserted into components of the magnetic circuit, a center plate 81 and magnets 82*a* and 82*b*.

As for assembling procedures of the magnetic circuit and this embodiment, said magnets 82*a* and 82*b*, which are neodymium each having an 8-mm thick ring form, are put in a thickness direction. The center plate 81 has a ring form with a 25.4-mm outside diameter, a 5.88-mm inside diameter, and a 4-mm thickness, and it is made of iron with the inside diameter and its ridge portions being chamfered by CO.4. Three sets of each magnet 82*a* and 82*b* and a single center plate 81 are used.

Figure 6A:
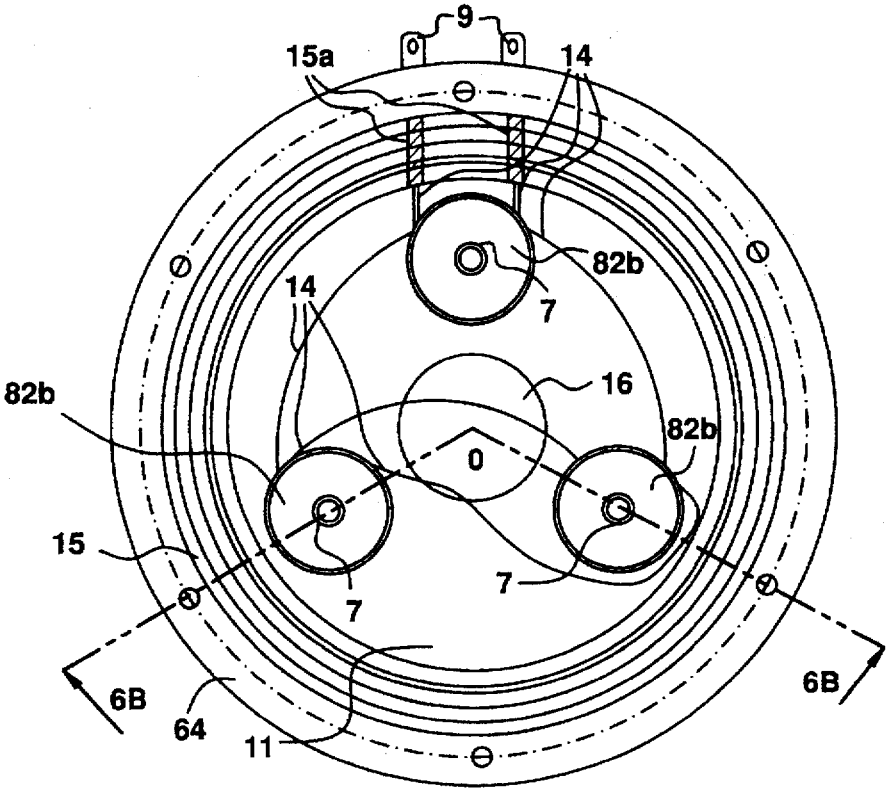
FIG. 6 is a front view (A) and a section (B) taken on line A-O-B in (A) illustrating an assembly process following the process in FIG. 5.
Figure 6B:
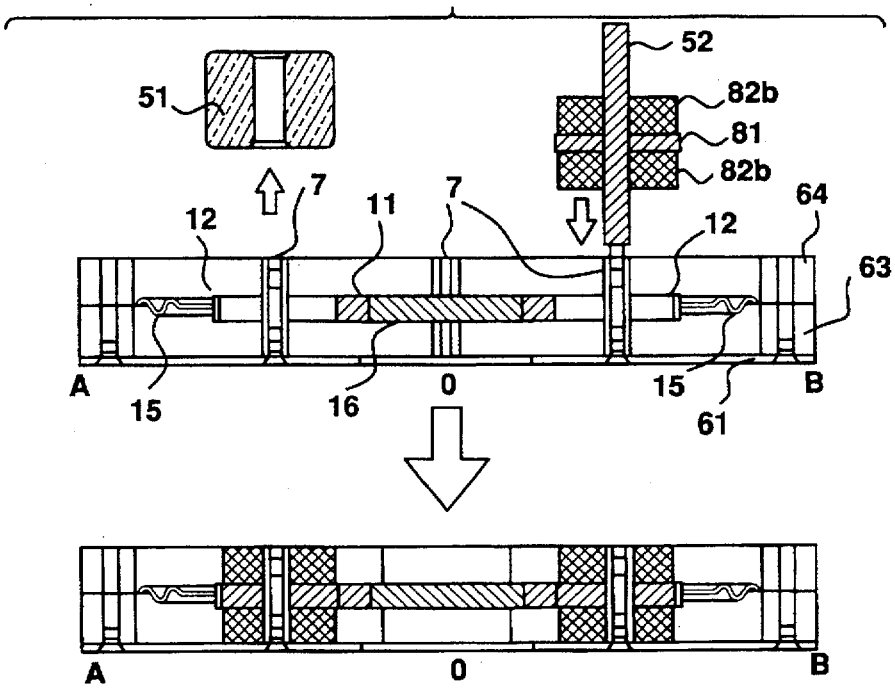
Figure 7A:
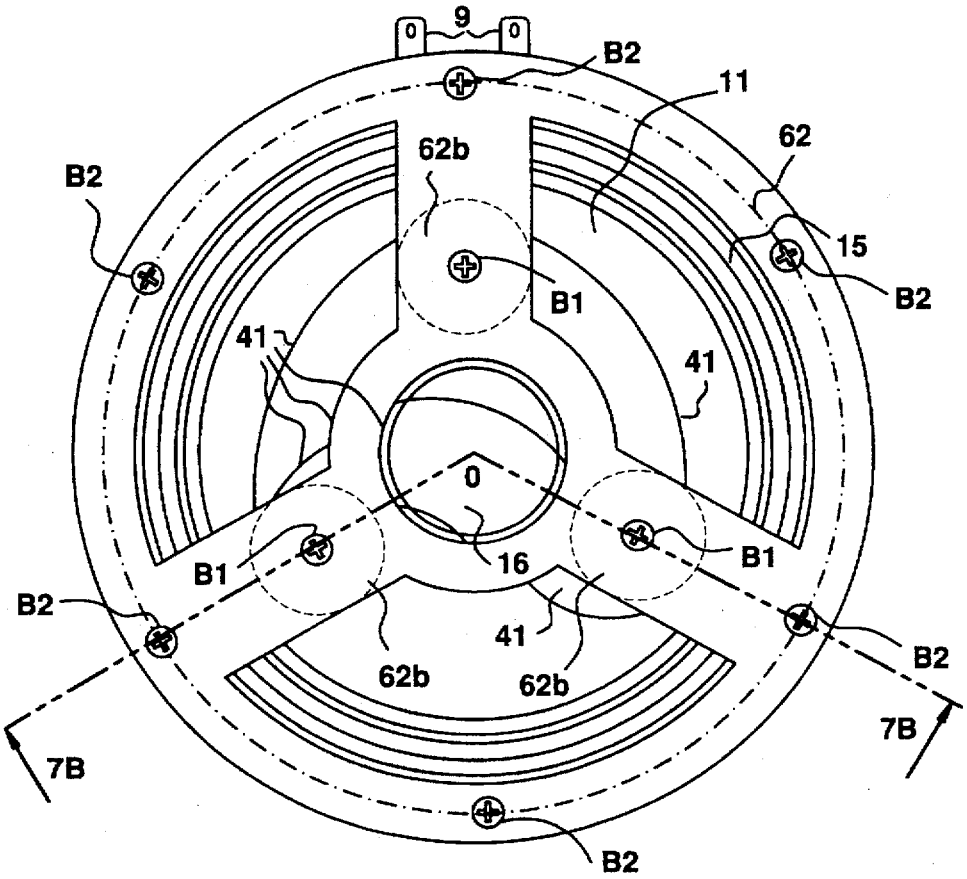
FIG. 7 is a front view (A) and a section (B) taken on line A-O-B in (A) illustrating an assembly process following the process in FIG. 6.
Figure 7B:
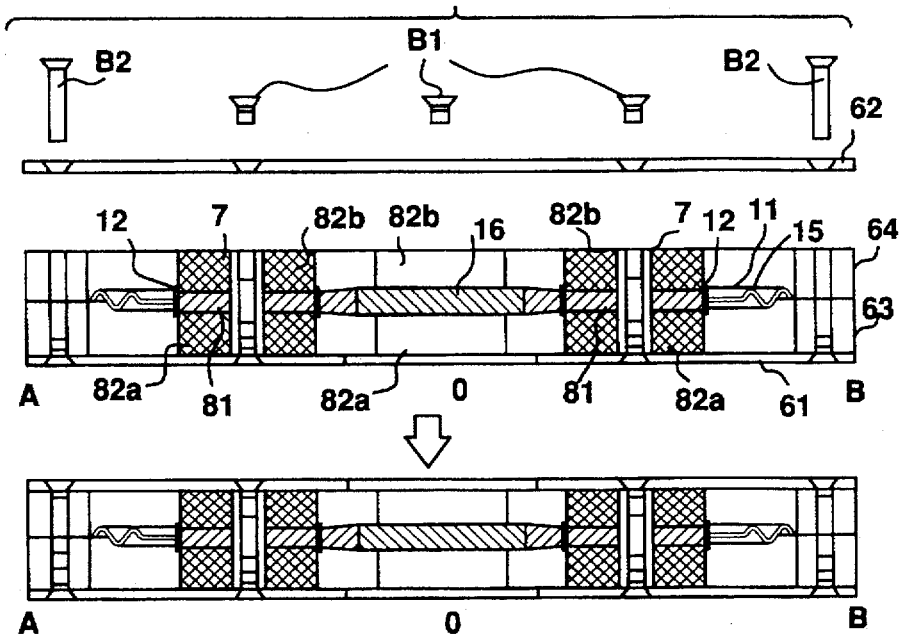

After driving a screw portion of an insertion jig 52 in FIG. 6, which has a 3-mm screw portion at its end with its outside diameter worked into the same size as for the outside diameter of the strut 7, into the tapped hole on the strut 7, the insertion jig 52 is inserted into the inner periphery of the magnet 82*a* with the surface of one pole (S pole) of the magnet 82*a* facing side of the frame 61, also inserted into the inner periphery of the center plate 81, and then it is inserted into the inner periphery of the magnet 82*b* with the surface of the N pole of the magnet 82*b* facing the center plate 81, which causes levitation of the magnet 82 due to a repulsive force of the magnets. If the jig 52 is inserted further, however, it is absorbed near the surface of the center plate 81. Accordingly, when said magnetic circuit is lowered downward as shown in FIG. 6, the strut 7 is inserted into the magnetic circuit and it is arranged inside the voice coil as shown in FIG. 6.

In this procedure, the assembly of the magnetic circuit is completed, therefore, the inner periphery of the voice coil 12 is arranged with a predetermined clearance in the outer periphery of the center plate 81, the magnet 82*a*, and the magnet 82*b*. After assembling at other two places in the same manner and removing said insertion jigs 52 from the struts 7, a ring 64 is placed at a predetermined position, in other words, with the holes and notches of the ring 63 fit to the positions of the tapped holes of the ring 63, and further a frame 62 is placed with its countersinks fit to the tapped holes of the ring 64 and the struts 7 by using countersunk screws B1 of 3×16 for installation at six places on the rings.

Since the screws B1 reaches the tapped holes of the ring 63 passing through the frame 62 and the ring 64, the ring 64 is fixed between the frame 62 and the ring 63 by tightening said screws B1. The magnetic circuit components (81, 82*a*, 82*b*) are installed with countersunk screws B1 of 3×5 through three countersinks on a support 62 of the frame 62, and they are fixed between the frame 61 and the frame 62. Accordingly, the diaphragm 11 and the center plate 81 or 81*a* in the magnetic circuit are placed at the center of the horizontal center line of the frame section and the frame and the magnets 82 in the magnetic circuit are arranged so as to be vertically symmetric about the horizontal center line, which completes a multipoint driving ultrathin loudspeaker having a 24-mm thickness in total.

Although the loudspeaker is 24 mm thick in total, thicker than the conventional loudspeaker in this embodiment, it can be designed so as to be 23 mm thick, the same size as for the conventional one or about 20-mm thick, thinner than that by investigating the plate thickness of the frames 61 and 62, their forms, and the stroke of the diaphragm system. In addition, though the magnetic circuit has a structure in which it is grasped between the frames 61 and 62 in this embodiment, the magnetic circuit can be grasped by plates 65 or the like through the frame as shown in FIG. 13 or the magnets 82*a* which is a component of the magnetic circuit can be fixed to the frame 61 as shown in FIG. 14 with the magnets 82*b* connected via a plate 65.

Figure 8:
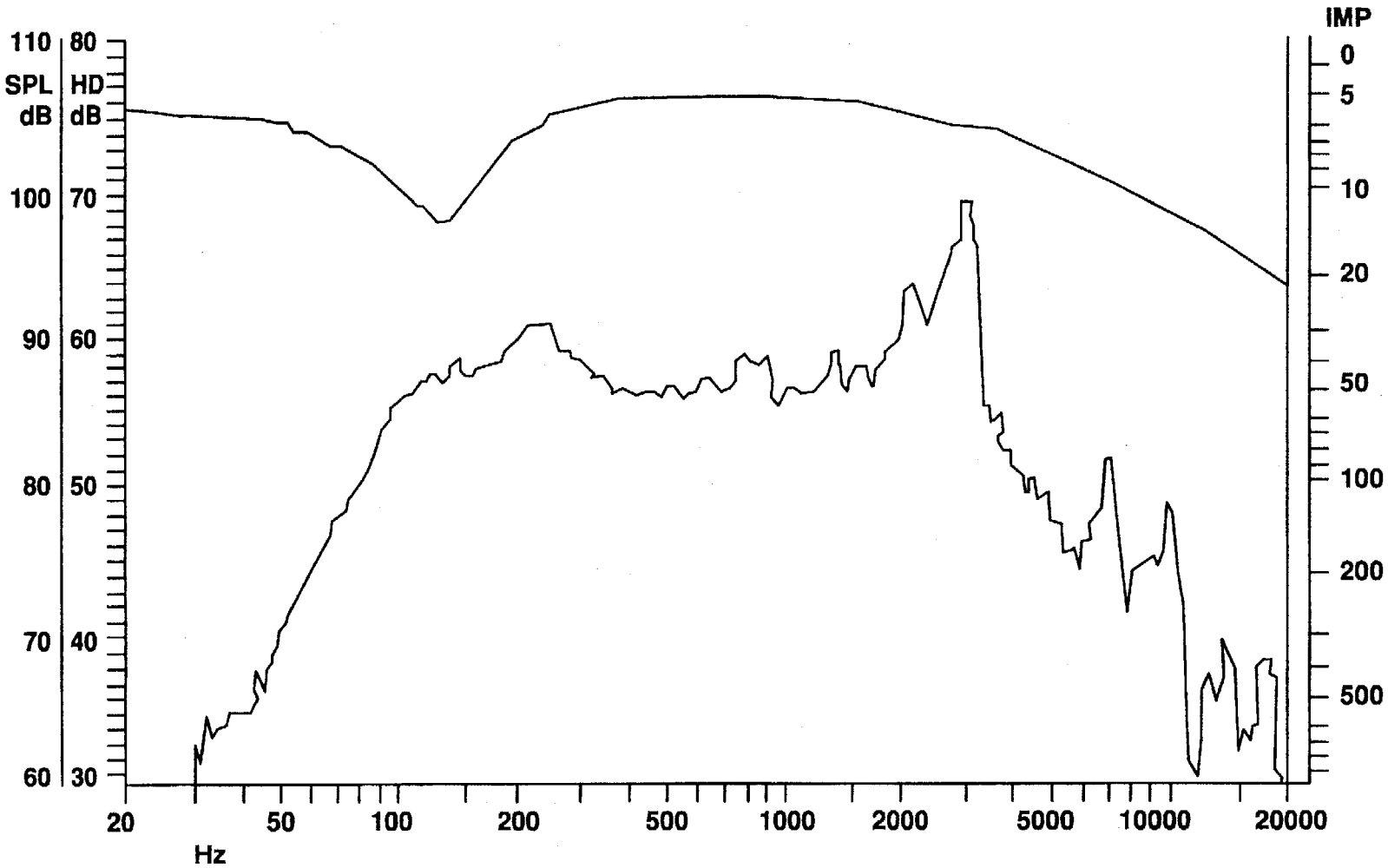
FIG. 8 is a frequency characteristic chart of the loudspeaker according to the invention.

As a result of measuring the loudspeaker assembled in the above procedure, the frequency characteristics in FIG. 8 can be obtained at a position above the shaft by one meter. Furthermore, a rolling has not occurred while the diaphragm 11 is oscillating with an amplitude of approximately 18 to 19 mm with 10 V applied at approximately 20 Hz to 1 kHz.

Although the component are made of different materials, for example, aluminum plates and resin rings are used for the frames and the struts 7 are made of brass in this embodiment as described above, the components can be integrated or the materials and forms be changed to be suitable for mass production on condition that the loudspeakers are mass-produced.

Figure 13A:
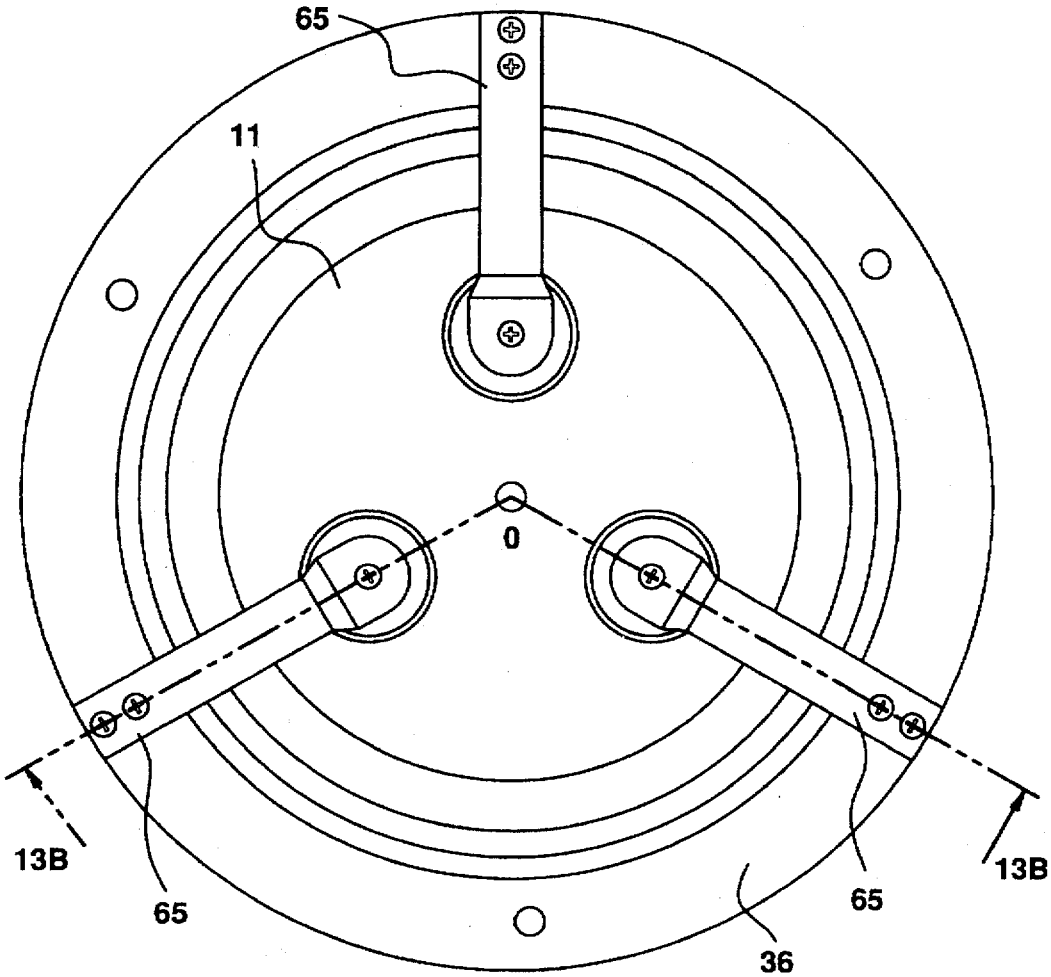
FIG. 13 is a front view (A) and a section (B) taken on line A-O-B in (A) illustrating still another configuration of the loudspeaker structure.
Figure 13B:
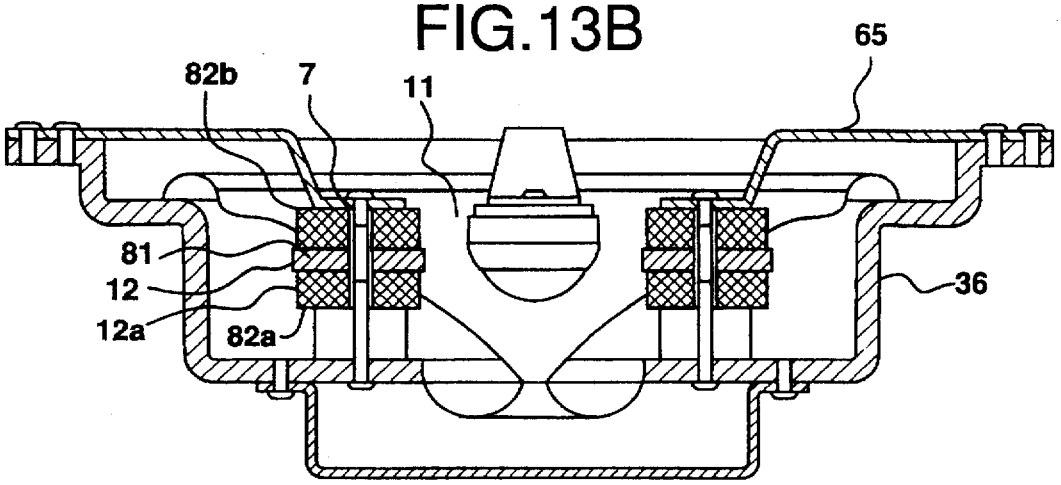
Figure 14:
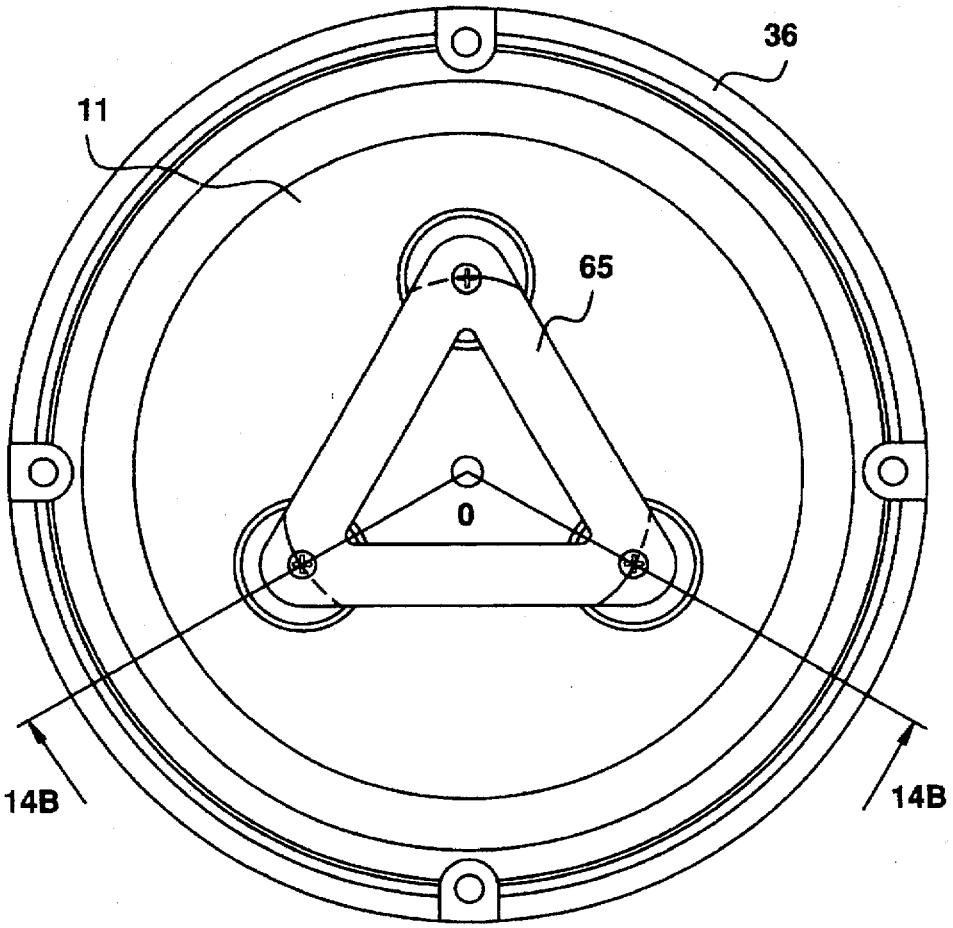
FIG. 14 is a front view (A) and a section (B) taken on line A-O-B in (A) illustrating another example of a magnetic circuit holding structure.
Figure 14B:
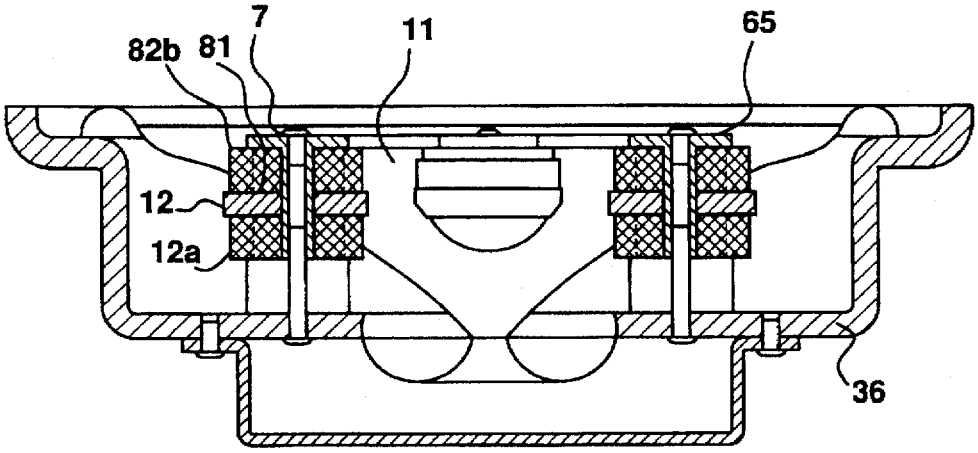

In addition, this structure can be easily applied to a cone-type loudspeaker by making a hole 11 *a* at an arbitrary position on a cone-shaped diaphragm 11 for connection with the voice coil 12 as shown in FIGS. 13 and 14, placing the outer periphery portion of the voice coil 12 or a voice coil bobbin 12*a* or the like with bonding in the side of the inner periphery of said hole 11*a*, and placing a repulsion magnetic circuit for driving the voice coil 12 in the side of the inner periphery of the voice coil bobbin 12*a*.

Figure 9A:
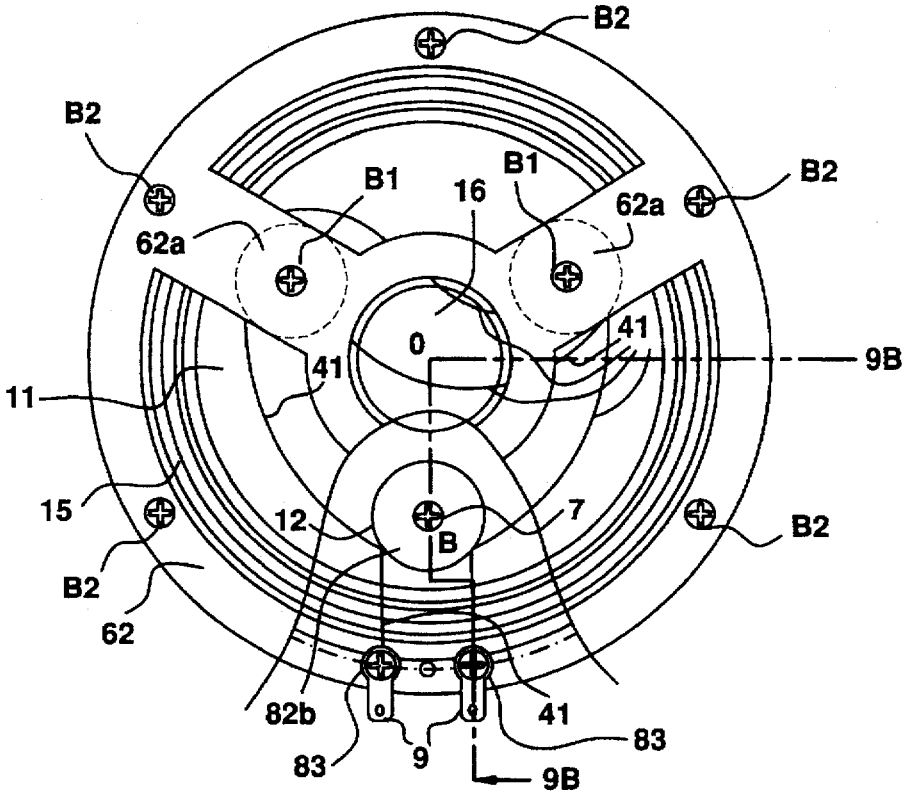
FIG. 9 is a front view (A) and a section (B) taken on line A-O-B in (A) illustrating another example of wiring for the loudspeaker.
Figure 9B:
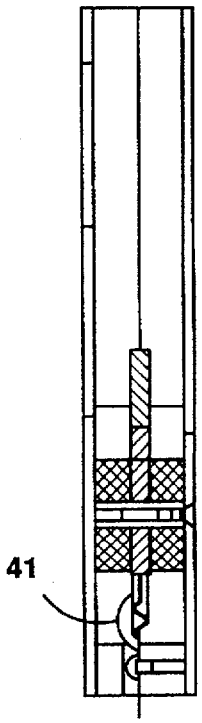

As for wiring between voice coils 12 and between the coils and input terminals, distribution leads 41 are trained over a side of its surface of the diaphragm 11 by using gilt yarn for said leads 41. For the input wiring, said gilt yarn can be directly connected to the terminal lugs 9 at the ends of the yarn by jumping the edge 15 at a position near the ends of said gilt yarn as shown in FIG. 9. If normal insulating-coated leads are used, the voice coils 12 can be connected in the same manner as for the above after the terminal section is exfoliated, with the same input wiring as for this embodiment in which the terminal section is connected to the conductor ends of the flat meshed gilt yarn 15*a* over the surface of the corrugation of the edge 15.

Furthermore, though the ends of the leads 41 are connected to the copper foil 12*b* at the outer periphery of the voice coils 12 in this embodiment, a terminal of the coil conductor can be directly connected to a terminal of the leads for wiring between the voice coils 12, therefore, the coil conductors can be connected each other near the most ends of the coil conductors with their terminals trained over the diaphragm 11, and for the input wiring, the most ends of the coil conductors can be connected to the conductor ends of the flat meshed gilt yarn 15*a* over the surface of the corrugation of the edge 15 in the same manner as for this embodiment.

Figure 10A:
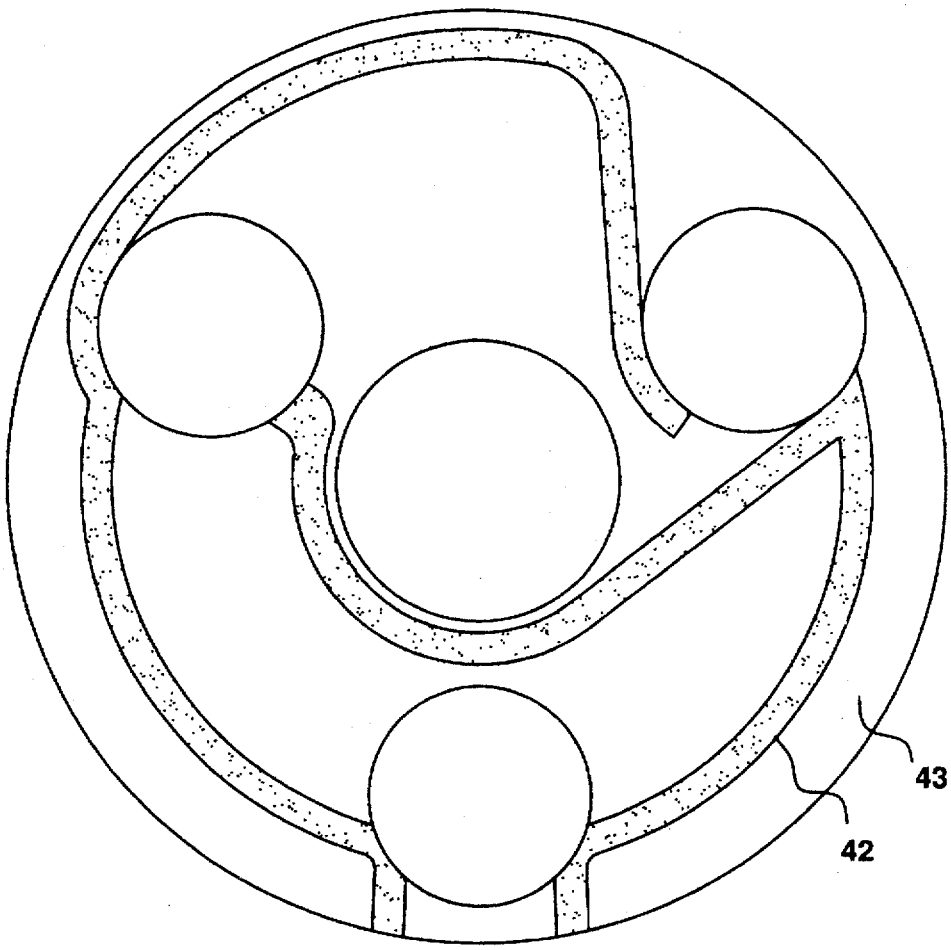
FIG. 10 is a front view (A) and a section view (B) illustrating an example of wiring between voice coils with a distribution pattern on a diaphragm.
Figure 10B:
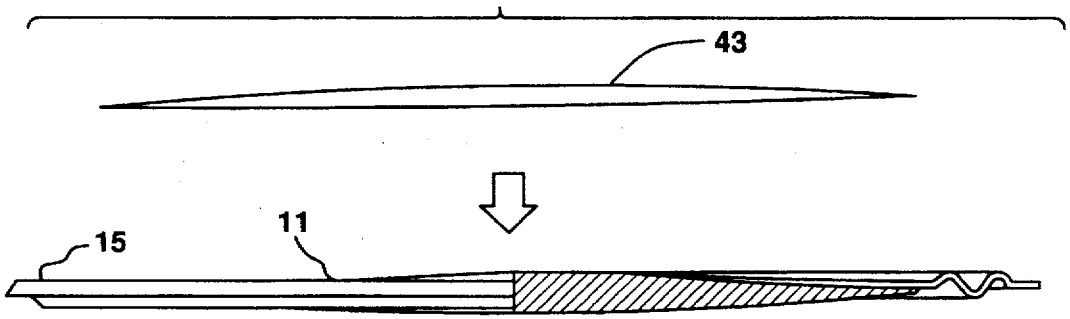
Figure 11:
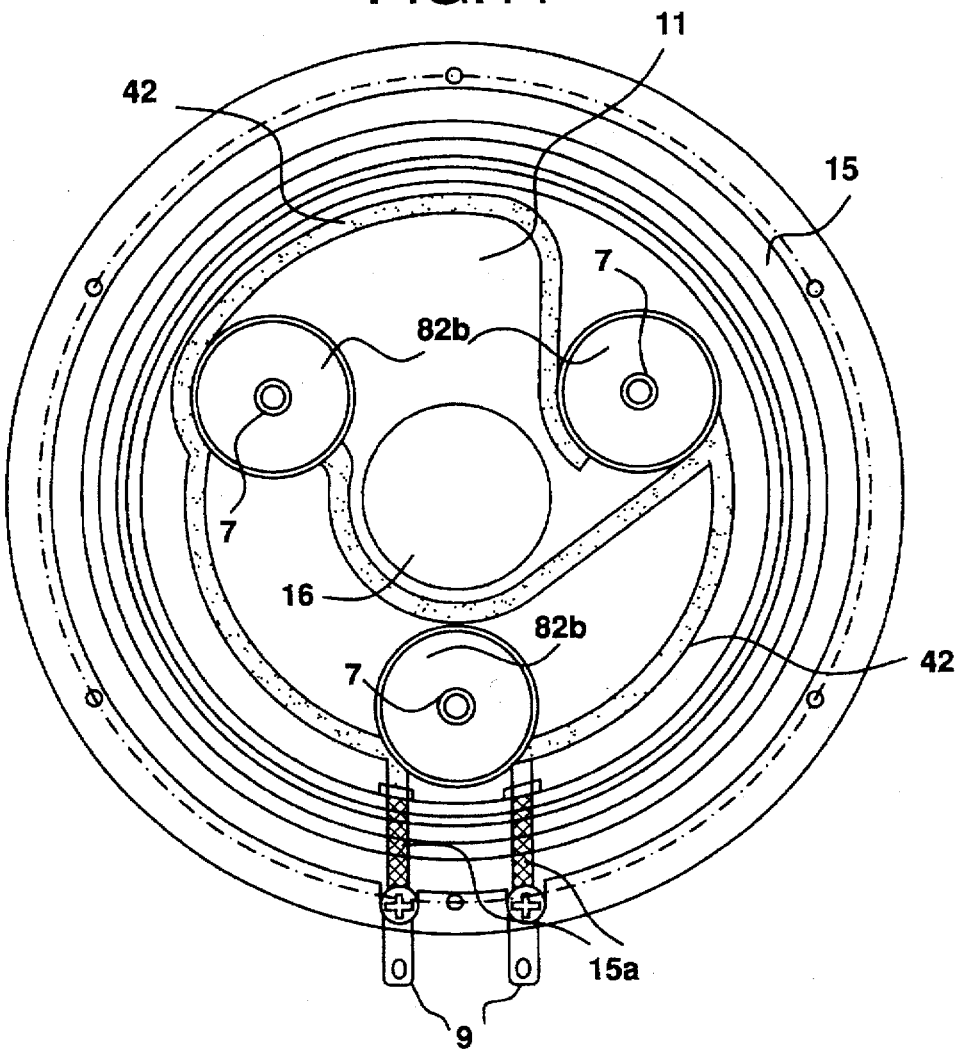
FIG. 11 is a front view of a wiring condition in the form in FIG. 10.

As for a means for wiring between voice coils 12 and between the coils and input terminals, there can be provided a distribution pattern 42 comprising conducting materials such as copper foil or the like on the right side or on the reverse side of the diaphragm 11 other than the means of this embodiment, for connecting the end of the pattern 42 with the terminals of the voice coil conductors or through the copper foil 12*b* at the outer periphery of the voice coils 12 and for input connection with conductors such as the flat meshed gilt yarn 15*a* trained over the surface of the corrugation of the edge 15. The distribution pattern 42 can be directly mounted on the diaphragm 11, and as shown in FIG. 10, it is also possible to paste a distribution pattern 42, which is made on the surface of a resin film 43 or the like, onto the diaphragm 11.

Though the diaphragm 11 and voice coils 12 have fixed forms in this embodiment, it is also possible to improve the performance, for example, to expand a reproduction frequency band, by using other forms.

Figure 12:
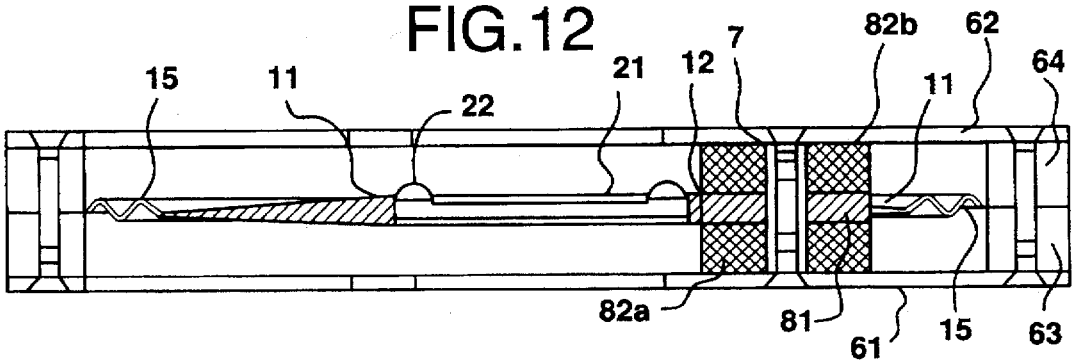
FIG. 12 is a section view illustrating another configuration of the loudspeaker structure.

For example, as shown in FIG. 12 (just a single magnetic circuit is shown and others are omitted here to prevent the diagram from being too complicated), the diaphragm 11 can include a second diaphragm 21 for reproducing a frequency band different from the frequency band reproduced by said diaphragm 11 with said second diaphragm 21 connected to the diaphragm 11 by means of a suspension such as a second edge 22 for a mechanical two-way connection or said second diaphragm 21 driven by a second voice coil 23. An extremely free selection is permitted for the dimensions, the setup places, and the amount of the voice coils 12 and the diaphragm 11 due to the multipoint driving system and for combinations between the forms and setups of said diaphragm 11 and the voice coils 12 since a resonant point of the diaphragm system depends on the forms or setups of the diaphragm 11 and the voice coils 12. 82*a*–82*f* represents magnets.

Figure 15A:
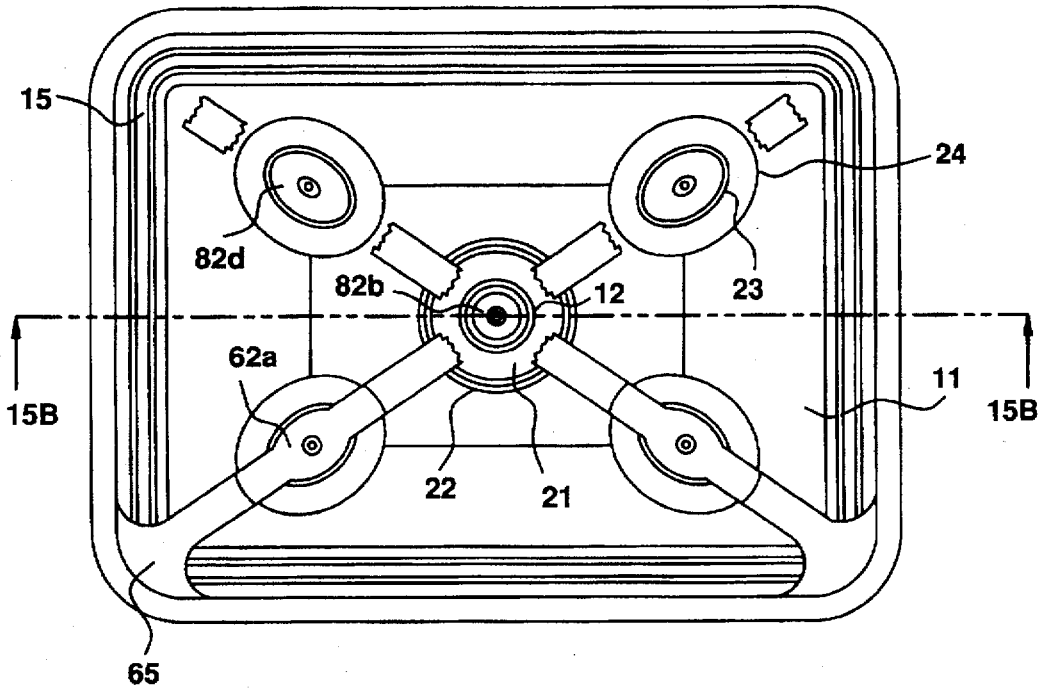
FIG. 15 is a front view (A) and a section (B) taken on line A-O-B in (A) illustrating a configuration in which a second diaphragm is placed in the diaphragm.
Figure 15B:
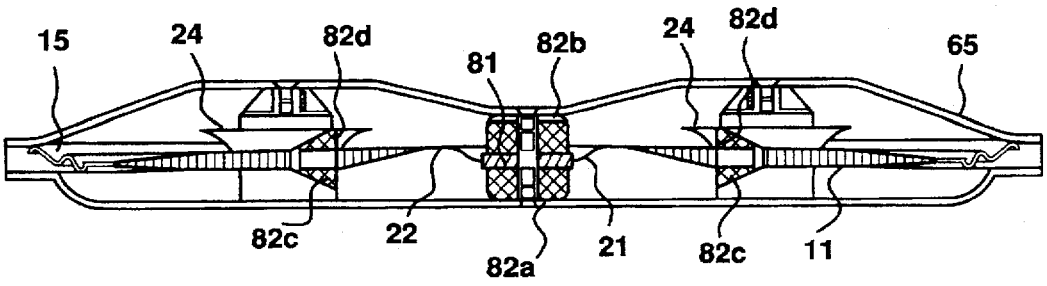

For example, as shown in FIG. 15, the diaphragm 11, a voice coil 12 for driving the second diaphragm 21, the second voice coil 23, or the magnetic circuit can be oval-shaped viewed from the front. Otherwise, a circular diaphragm 11 and an oval (or the like) diaphragm 21 can be assembled like a single diaphragm 11 with optimization of the positions of the diaphragm 11 and the voice coils 12 arranged at positions where the control of resonance is considered. In addition, a cone-shaped second diaphragm 21 can be placed at the center with being enclosed by a planar-ring-shaped diaphragm 11, or various configurations other than said forms, for example, a semi-oval, ovoid, or polygonal figure, can be used for the diaphragm 11, the voice coil 12 for driving the diaphragm 21, and the magnetic circuit.

In addition, it is possible to change the characteristics of the middle or higher frequency band by joining a third diaphragm 24, for example, generally called sub-cone or withers, to the diaphragm 11, the voice coil 12 for driving the second diaphragm 21, the voice coil 23, or the voice coil bobbin 12*a*, and also possible to control directivity or tones of the loudspeaker by changing the configuration, material, or setup of the diaphragm 24. For example, as shown in FIG. 16, they can be controlled by making the third diaphragm 24 having an oval, ovoid, or arbitrary form in its front view and changing a direction viewed from the front in which said third diaphragm 24 is installed. Further, a plurality of diaphragms can be placed by utilizing the characteristics of the multipoint driving and naturally it is possible to combine the figures other than these arbitrarily. Accordingly, the performance can be improved by arbitrary selection out of said combined forms, and this invention has an advantage of an extremely wide range of configurations to be designed.

As described in detail above, according to the loudspeaker structure of the invention, the reproduction frequency band can be greatly expanded in comparison with that of the conventional ultrathin loudspeaker we have already proposed, so as to provide a loudspeaker structure suitable for use in an almost full range.

Although there is a conventional multipoint driving loudspeaker, according to the loudspeaker structure of this invention, the structure is simpler than the conventional multipoint driving loudspeaker since there are not any components forming magnetic gaps outside the voice coils like the conventional one. Therefore, a multipoint driving loudspeaker can be made very easily and this structure can be easily applied to a loudspeaker having a cone-shaped diaphragm, which makes it possible to achieve a multipoint driving loudspeaker meeting an extremely wide range of configurations.

The conventional multipoint driving loudspeaker has a structure in which a diaphragm system can be easily rolled since voice coils for driving a diaphragm are placed at positions greatly far from the diaphragm due to a structure of a magnetic circuit. According to this invention, however, particularly an ultrathin and multipoint driving loudspeaker has an advantage of greatly decreasing serious defects such as a contact between a magnetic circuit and a voice coil at a voice coil at a great amplitude of the diaphragm system, since the edge on the outer periphery of the diaphragm is near the central shaft in the sectional side elevation of the loudspeaker and it is placed within a range of the thickness of the center plate to position the diaphragm system supports on or about the center line, so that a favorable amplitude balance can be achieved at the center of gravity and the loudspeaker exhibits excellent functions on characteristics of withstanding rolling of the diaphragm system.

According to the invention, since the magnetic circuit is grasped between flames or plates through the flames, the magnetic circuit itself acts as a strut inside the frames arranged at the upper and lower sides of the diaphragm system of the loudspeaker. In other words, the magnetic circuit acts as a component of the frame structure, and the magnetic circuit is integrated into the frame structure supporting the diaphragm system. Additionally, said magnetic circuit as a part of this integrated structure is very solid as a structure in the entire frame. This makes the frame structure extremely solid. As a result, the frame configurations can be very simple and they can be made in a simple technique, as well as a required strength of the frames can be obtained even if they are thin. In addition, this invention has an advantage that the more the magnetic circuits are included, the more the multipoint driving loudspeaker like this exhibits its effects.

Furthermore, by making the configurations of the diaphragm and the voice coils variable, it is possible to improve the performance such as to expand the reproduction frequency band. For example, the diaphragm, the voice coils for driving the second diaphragm, and the magnetic circuit can be oval-shaped viewed from the front, or the diaphragm can be circular and the second diaphragm be oval with the diaphragm and the voice coils arranged at appropriate positions where the control of resonance is considered to assemble a plurality of diaphragms as if they were a single diaphragm. In addition, this invention has an advantage of an extremely wide range of configurations to be designed, for example, by positioning a cone-shaped diaphragm at the center and a planar-ring-shaped diaphragm outside said diaphragm or by using a diaphragm, voice coils for driving a second diaphragm, or a magnetic circuit having a configuration, such as, for example, a semi-oval, ovoid, or polygonal form.

In addition, it is possible to change the characteristics of the middle or higher frequency band by joining a third diaphragm to the diaphragm, the voice coil for driving the second diaphragm, or the voice coil bobbin, and also possible to control directivity or tones of the loudspeaker by changing the configuration, material, or setup of said third diaphragm.

In connection between the voice coils and wiring for input terminals, there are advantages that resonance of the diaphragm can be depressed by using gilt yarn as wiring leads trained over one face of the diaphragm skillfully, and as for the connection between the input terminal and the gilt yarn, that labor for wiring can be reduced by connecting the end of the gilt yarn directly m the terminal lugs with jumping the edge without any wire break caused by swinging of the jumping section.

We claim:

1. A multipoint driving loudspeaker in which a single diaphragm is driven by a plurality of voice coils having a plurality of holes (11*a*) for connection with voice coils (12) at positions off the center of the diaphragm (11), an outer periphery of each voice coil (12) or each voice coil bobbin (12*a*) constituting said voice coil (12) being joined to an inner periphery of the respective holes, each of said voice coils (12) having a magnetic circuit for driving said voice coil (12) being placed at an inner periphery of the voice coil (12) or the voice coil bobbin (12*a*) correspondingly to each voice coil (12), and said magnetic circuit including two magnets (82) arranged with the same poles positioned at opposite sides of each other and being used as a repulsion magnetic circuit with a center plate (81) grasped between the magnets.

2. A loudspeaker structure according to claim 1, wherein is placed an edge (15) for supporting the diaphragm (11) at the outer periphery of said diaphragm, and a part supporting the outer periphery of the diaphragm of said edge (15) is close to a central axis in a sectional side of said loudspeaker and has a dimension within a thickness of the center plate (81).

3. A loudspeaker structure according to claim 1, wherein the center plate (81) and the magnets (82) are grasped by means of loudspeaker frames (61, 62) directly or via a plate (65).

4. A loudspeaker structure according to claim 1, wherein one magnet (82*a*) which is a component of the repulsion magnetic circuit is fixed to one of loudspeaker frames (61, 62) and the other magnets (82*b*) are connected to each other by means of a plate (65).

5. A loudspeaker structure according to claim 1, wherein there is provided a second diaphragm (21) for regenerating a frequency band other than a frequency band regenerated by the diaphragm (11) in said diaphragm.

6. A loudspeaker structure according to claim 1 or 5, wherein the second diaphragm (21) is joined with the diaphragm (11) via a second edge (22).

7. A loudspeaker structure according to claim 1 or 5, wherein a second voice coil (23) is joined with the second diaphragm (21) and the second diaphragm (21) is arranged to be driven by said voice coil (23).

8. A loudspeaker structure according to claim 1 or 5, wherein each of the diaphragm (11), the second diaphragm (21), the voice coil (12), a second voice coil (23), and the magnetic circuit has a configuration other than a circular form such as an oval, semi-oval, or a polygon.

9. A loudspeaker structure according to claim 1 or 5, wherein the diaphragm (11) does not have the same configuration in a front view as that of the second diaphragm (21) and they are configured like a single diaphragm.

10. A loudspeaker structure according to claim 1 or 5, wherein there is provided the second diaphragm (21) for regenerating a frequency band other than a frequency band regenerated by the diaphragm (11) in said diaphragm, and a third diaphragm (24) is joined with voice coils (12, 23) for driving said diaphragm (11) or the second diaphragm (21) or parts constituting the voice coils.

11. A loudspeaker structure according to claim 10, wherein the third diaphragm (24) has a configuration other than a circular form such as an oval or a polygon in a front view.

12. A loudspeaker structure according to claim 1, wherein the voice coils (12) are connected each other by means of distribution leads (41) laid on a surface of the diaphragm and an input terminal is connected to a conductor such as flat meshed gilt yarn (15*a*) laid along a corrugation of an edge (15).

13. A loudspeaker structure according to claim 1, wherein the voice coils (12) are connected each other by means of distribution leads (41) laid on a surface of the diaphragm and for an input connection an end of a gilt yarn is connected directly to a terminal lug (9) with jumping over a surface of an edge (15).

14. A loudspeaker structure according to claim 1, wherein the voice coils (12) are connected each other by means of distribution leads (41) laid on a surface of the diaphragm, at a front or a rear side of the diaphragm (11), a distribution pattern (42) made of a conductor such as copper foil (12*b*) is arranged with a connection via an end of said pattern (42) and a wire terminal of the voice coil (12) or the copper foil (12*b*) on the outer periphery of the voice coil (12), and an input terminal is connected to a conductor such as flat meshed gilt yarn (15*a*) laid along a corrugation of an edge (15).

15. A loudspeaker structure according to claim 14, wherein the distribution pattern (42) made of copper foil (12*b*) or the like is formed on a surface of an insulating film (43) such as a resin film and said film (43) is attached to the diaphragm (11).

* * * * *